US012735242B2

(12) United States Patent
Solanki et al.

(10) Patent No.: US 12,735,242 B2
(45) Date of Patent: Sep. 15, 2026

(54) DISPENSER

(71) Applicant: Colgate-Palmolive Company, New York, NY (US)

(72) Inventors: Juhi Solanki, New Brunswick, NJ (US); Mark Bartlett, North East, PA (US)

(73) Assignee: Colgate-Palmolive Company, New York, NY (US)

( * ) Notice: Subject to any disclaimer, the term of this patent is extended or adjusted under 35 U.S.C. 154(b) by 30 days.

(21) Appl. No.: 18/547,802

(22) PCT Filed: Feb. 23, 2022

(86) PCT No.: PCT/US2022/017460
§ 371 (c)(1),
(2) Date: Aug. 24, 2023

(87) PCT Pub. No.: WO2022/187048
PCT Pub. Date: Sep. 9, 2022

(65) Prior Publication Data

US 2024/0124213 A1 Apr. 18, 2024

Related U.S. Application Data

(60) Provisional application No. 63/157,155, filed on Mar. 5, 2021, provisional application No. 63/162,663, filed on Mar. 18, 2021.

(51) Int. Cl.
*B65D 83/04* (2006.01)

(52) U.S. Cl.
CPC ..... *B65D 83/0409* (2013.01)

(58) Field of Classification Search
CPC .... B65D 83/0409; B65D 83/04; B65D 59/00; A61J 1/03; A61J 1/14; A61J 7/0427
(Continued)

(56) References Cited

U.S. PATENT DOCUMENTS 716,257 A * 12/1902 Lunt ..... B65D 47/061 222/522
1,676,109 A 7/1928 Oldenbusch
(Continued)

FOREIGN PATENT DOCUMENTS

CH 380300 7/1964
CH 380300 A * 7/1964 ..... B65D 83/0409
(Continued)

OTHER PUBLICATIONS

International Search Report and the Written Opinion of the International Searching Authority issued in International Application PCT/US2022/017460 mailed May 23, 2022.

*Primary Examiner* — Rakesh Kumar

(57) ABSTRACT

A dispenser (10) for holding and dispensing consumable products (300). The dispenser may include a first component (100) having a storage cavity (103) containing a plurality of consumable products, a closer member (150) that closes an open end (104) of the storage cavity, and a second component (200) pivotably coupled to the first component for dispensing one of the consumable products at a time. The closure member has a dispensing aperture (160) so that one of the consumable products can fit therethrough and pass onto a cup-shaped member (250) of the second component. Then, the closure member can be altered from a closed state to an open state so that a user can remove the one of the consumable products from the cup-shaped member of the second component. A blocker arm (260) protrudes from the cup-shaped member to prevent additional ones of the consumable products from being dispensed when the second component is in the open state.

16 Claims, 28 Drawing Sheets

(58) Field of Classification Search
USPC ..... 221/255, 253, 258, 208, 2
See application file for complete search history.

(56) References Cited

U.S. PATENT DOCUMENTS 2,433,472 A * 12/1947 Mclaughlin ..... B65D 83/0409 221/256
2,669,349 A 2/1954 Silver
2,673,777 A * 3/1954 Ward ..... B65D 83/0409 221/200
2,683,554 A * 7/1954 Mulhauser, Jr. ... B65D 83/0409 221/152
2,962,190 A * 11/1960 Horland ..... B65D 83/0409 221/202
3,191,803 A 6/1965 Hamilton
3,276,636 A * 10/1966 Johnson, Jr. ..... B65D 83/0409 221/266
3,289,885 A * 12/1966 Villaveces ..... B65D 47/265 215/901
3,318,491 A * 5/1967 Williamson ..... B65D 83/0409 222/542
3,430,810 A 3/1969 Baller et al.
3,586,208 A * 6/1971 Hussey ..... B65D 83/0409 221/302
3,622,041 A * 11/1971 Borsum ..... B65D 51/24 221/202
3,627,160 A * 12/1971 Horvath ..... B65D 50/061 215/206
3,836,055 A * 9/1974 Katzmark ..... G01F 11/261 222/455
4,230,236 A * 10/1980 Boulter ..... B65D 83/0409 221/281
4,282,990 A * 8/1981 Miyashita ..... G01F 11/261 222/362
4,283,000 A * 8/1981 White ..... B65D 5/722 229/148
4,354,619 A 10/1982 Wippermann et al.
4,402,425 A 9/1983 von Schuckmann
4,415,098 A 11/1983 Haas
4,492,316 A 1/1985 Emms
4,530,447 A * 7/1985 Greenspan ..... B65D 83/04 222/543
4,653,668 A * 3/1987 Gibilisco ..... B65D 83/0409 221/289
4,744,492 A * 5/1988 Hackmann ..... B65D 83/0409 221/204
4,805,765 A * 2/1989 Barrett ..... B65D 5/724 229/122
4,848,593 A * 7/1989 Jeandaud ..... B65D 83/049 221/256
4,971,203 A * 11/1990 Weinstein ..... B65D 83/0481 206/536
5,018,644 A * 5/1991 Hackmann ..... B65D 83/0409 221/152
5,020,719 A * 6/1991 Roth ..... B65D 5/5213 221/302
5,108,006 A * 4/1992 Tieke ..... B65D 83/0409 221/152
5,127,543 A * 7/1992 Meisels ..... A24F 15/005 221/281
5,174,471 A 12/1992 Kozlowski et al.
5,351,858 A 10/1994 Bar-Yona et al.
5,405,047 A * 4/1995 Hansen ..... B65D 83/0409 221/289
5,443,204 A * 8/1995 O'Donnell ..... B65D 5/724 229/122
5,467,903 A * 11/1995 Sorensen ..... G01F 11/261 222/455
5,657,901 A 8/1997 Farside
5,816,441 A 10/1998 Farside
5,954,228 A 9/1999 Minnette
6,142,337 A 11/2000 Schreckenberg et al.
6,206,235 B1 3/2001 Green
6,267,265 B1 * 7/2001 Issa ..... B65D 83/0409 222/536
6,273,294 B1 8/2001 Petzold et al.
6,726,058 B2 4/2004 Giraud
6,948,634 B2 9/2005 Evans et al.
7,243,817 B2 7/2007 Giraud
7,533,785 B2 5/2009 Smith et al.
7,648,037 B2 * 1/2010 Ohashi ..... B65D 47/30 220/255
7,978,564 B2 * 7/2011 De La Huerga .. A61M 5/16827 700/242
8,028,856 B2 10/2011 Erdelyi et al.
8,033,425 B2 10/2011 Gelardi
8,439,225 B2 5/2013 Schick
8,459,498 B2 6/2013 Giraud
9,332,827 B2 5/2016 Lee
9,592,948 B2 * 3/2017 Messner ..... B65D 83/04
9,636,279 B2 * 5/2017 Song ..... A61J 7/0427
9,656,796 B1 * 5/2017 Cammarata ..... B65D 83/0409
10,098,817 B2 10/2018 Tegborg et al.
10,172,765 B2 1/2019 Sabharwal et al.
10,532,878 B2 1/2020 Homma et al.
10,730,686 B2 8/2020 Wright et al.
2004/0004083 A1 1/2004 Grant
2004/0124204 A1 * 7/2004 Giraud ..... B65D 83/0409 221/263
2004/0182879 A1 * 9/2004 Kingsland ..... B65D 83/0436 221/263
2005/0236419 A1 10/2005 Moenikeij et al.
2005/0269348 A1 * 12/2005 Limback ..... A47L 15/4409 221/263
2007/0000938 A1 1/2007 Renaud
2007/0194890 A1 * 8/2007 Brue ..... G16H 40/67 340/309.16
2009/0194556 A1 * 8/2009 Klein ..... B65D 83/0409 221/266
2010/0065577 A1 * 3/2010 Coughlin ..... G07F 11/24 221/277
2010/0258583 A1 10/2010 Schick
2011/0108567 A1 5/2011 Giraud et al.
2011/0133948 A1 * 6/2011 Ervin ..... A61J 7/0409 340/687
2011/0147404 A1 * 6/2011 Dobie, III ..... B65D 47/265 221/303
2011/0165034 A1 * 7/2011 Carlson ..... B67D 7/08 222/77
2011/0227734 A1 * 9/2011 Ortenzi ..... G08B 13/1436 340/568.1
2012/0056000 A1 * 3/2012 Shores ..... A61J 7/0418 235/492
2013/0200033 A1 * 8/2013 Zonana ..... B65D 83/0409 215/231
2014/0188502 A1 * 7/2014 Defrank ..... G16H 40/67 705/2
2014/0266760 A1 * 9/2014 Burke, Jr. ..... G16H 20/13 340/687
2014/0278468 A1 * 9/2014 Mayer ..... G16H 40/67 705/2
2014/0319138 A1 * 10/2014 Polt ..... B65D 43/0227 220/254.3
2015/0166247 A1 * 6/2015 Ashbaugh ..... A61J 7/0076 221/265
2017/0036846 A1 * 2/2017 Bressan ..... B65D 85/60
2022/0227567 A1 * 7/2022 Hayakawa ..... A61J 7/0076

FOREIGN PATENT DOCUMENTS

DE 2925432 1/1981
DE 3221719 12/1983
DE 202007018407 7/2008
DE 202011100531 8/2012
DE 202012101982 9/2013
EP 0078126 10/1983
EP 1644267 4/2006
EP 2748085 7/2014
EP 2830975 2/2015
EP 2853505 4/2015

(56) References Cited

FOREIGN PATENT DOCUMENTS

| | | |
|---|---|---|
| EP | 3002002 | 4/2016 |
| FR | 2986786 | 8/2013 |
| GB | 561712 | 6/1944 |
| GB | 2257421 | 1/1993 |
| WO | 1996/041756 | 12/1996 |
| WO | 2000/064783 | 11/2000 |
| WO | 2012/082119 | 6/2012 |

* cited by examiner

DISPENSER

CROSS-REFERENCE TO RELATED APPLICATIONS

The present application claims priority to U.S. Provisional Patent Application Ser. No. 63/157,155, filed Mar. 5, 2021 and U.S. Provisional Patent Application Ser. No. 63/162,663, filed Mar. 18, 2021, the entireties of which are incorporated herein by reference.

BACKGROUND

People enjoy being able to carry breath freshening or other oral or personal care treatment products with them when they are on-the-go. For example, there are many different types of small hard mints that can be carried in a person's pocket and readily pulled out for use as desired. Existing packaging for such products consist of a simple container with an openable lid that, once opened, permits a user to either grab a desired number of the products or requires the user to hold the container upside down to spill out its contents. The containers that are turned upside-down for dispensing do not allow for accurate dosing and the containers that require a user to grab the product out of the container are not useful for all persons depending on dexterity and slipperiness of the product. Moreover, there are hygienic concerns that arise when more products than desired are removed from the container and then put back into the container after being handled by the user. Thus, a need exists for a dispenser that overcomes the noted deficiencies.

BRIEF SUMMARY

The present invention may be directed to a dispenser for holding and dispensing consumable products. The dispenser may include a first component having a storage cavity containing a plurality of consumable products, a closer member that closes an open top end of the storage cavity, and a second component pivotably coupled to the first component for dispensing one of the consumable products at a time. The closure member has a dispensing aperture so that one of the consumable products can fit therethrough and pass onto a cup-shaped member of the second component. Then, the closure member can be altered from a closed state to an open state so that a user can remove the one of the consumable products from the cup-shaped member of the second component. A blocker arm protrudes from the cup-shaped member to prevent additional ones of the consumable products from being dispensed when the second component is in the open state.

In one aspect, the invention may be a dispenser comprising: a first component comprising a storage cavity having an open end, the storage cavity containing a plurality of consumable products; a closure member coupled to the first component and closing the open end of the storage cavity, the closure member comprising a dispensing aperture configured to permit one of the consumable products to fit therethrough at a time; and a second component pivotably coupled to the first component, the second component comprising a cup-shaped member configured to hold the one of the consumable products and a blocker arm; wherein the second component is pivotable relative to the first component between: (1) a closed state in which the cup-shaped member of the second component is at least partially located within the dispensing aperture of the closure member for loading one of the consumable products onto the cup-shaped member; and (2) an open state in which the cup-shaped member pivots away from the dispensing aperture to permit removal of the one of the consumable products from the cup-shaped member and the blocker arm prevents the consumable products remaining in the storage cavity from being dispensed through the dispensing aperture.

In another aspect, the invention may be a dispenser comprising: a storage component comprising a storage cavity containing a plurality of consumable products and a dispensing aperture that is configured to dispense one of the consumable products at a time; a dispensing component pivotably coupled to the storage component, the dispensing component comprising a holding member configured to hold the one of the consumable products; wherein the dispensing component is pivotable relative to the storage component between: (1) a closed state in which the holding member of the dispensing component becomes loaded with one of the consumable products; and (2) an open state in which an opening is created between a front portion of the storage component and a front portion of the dispensing component while the holding member of the dispensing component continues to hold the one of the consumable products, and wherein the one of the consumable products is visible through the opening without being dispensed from the dispenser.

In yet another aspect, the invention may be a dispenser comprising: a storage component comprising a storage cavity containing a plurality of consumable products and a dispensing aperture that is configured to dispense one of the consumable products at a time; a dispensing component pivotably coupled to the storage component, the dispensing component comprising a holding member configured to hold the one of the consumable products and a blocker arm; wherein the dispensing component is pivotable relative to the storage component between: (1) a closed state in which the holding member of the dispensing component becomes loaded with one of the consumable products; and (2) an open state in which the one of the consumable products becomes accessible to a user and the blocker arm prevents any of the consumable products remaining in the storage cavity from being dispensed through the dispensing aperture.

The present invention may be directed to a dispenser for holding and dispensing consumable products. The dispenser may be small enough to fit inside of a pocket of a user's clothing. The dispenser may include a housing having an internal cavity containing a plurality of consumable products, the internal cavity including a main compartment and a dispensing compartment. A cover member closes the open top end of the internal cavity. The cover member is slidably coupled to the housing between: (1) a closed state in which one or more of the consumable products are permitted to move from the main compartment into the dispensing compartment while being prevented from being dispensed from the dispensing compartment; and (2) an open state in which the consumable products are prevented from moving between the main compartment and the dispensing compartment and the one or more consumable products located in the dispensing compartment are configured to be dispensed.

In one aspect, the invention may be a dispenser comprising: a housing comprising an internal cavity having an open top end, the internal cavity containing a plurality of consumable products and comprising a main compartment and a dispensing compartment; a cover member closing the open top end of the internal cavity, the cover member slidably coupled to the housing between: (1) a closed state in which one or more of the consumable products are permitted to move from the main compartment into the dispensing compartment while being prevented from being dispensed from the dispensing compartment to an external environment; and (2) an open state in which the consumable products are prevented from moving between the main compartment and the dispensing compartment and the one or more consumable products located in the dispensing compartment are configured to be dispensed to the external environment.

In another aspect, the invention may be a dispenser comprising: a housing comprising an internal cavity containing a plurality of consumable products and a divider wall that separates the internal cavity into a main compartment and a dispensing compartment, the divider wall comprising an opening that forms a passageway from the main compartment into the dispensing compartment; a cover member slidably coupled to the housing between an open state and a closed state, the cover member comprising a stopper wall that at least partially blocks the opening of the divider wall to prevent movement of the consumable products from the main compartment into the dispensing compartment when the cover member is in the open state and does not block the opening of the divider wall to allow movement of the consumable products from the main compartment into the dispensing compartment when the cover member is in the closed state; and wherein when the cover member is in the open state the consumable products located within the dispensing compartment are configured to be dispensed from the internal cavity, and wherein when the cover member is in the closed state the consumable products located within the dispensing compartment are prevented from being dispensed from the internal cavity.

In yet another aspect, the invention may be a dispenser comprising: a housing; a cover member slidably coupled to the housing; the housing and the cover member collectively defining an internal cavity containing a plurality of consumable products, the internal cavity being divided into a main compartment and a dispensing compartment by a divider assembly the dispensing compartment configured to hold no more than one of the consumable products at a time; and wherein the housing and the cover member are slidable relative to one another between: (1) a closed state whereby a single one of the plurality of consumable products is permitted to move from the main compartment into the dispensing compartment through an opening in the divider assembly while being prevented from exiting the internal cavity; and (2) an open state wherein the single one of the plurality of consumable products is permitted to exit the internal cavity and additional ones of the plurality of consumable products are prevented from moving from the main compartment into the dispensing compartment.

In still another aspect, the invention may be a dispenser comprising: a housing comprising an internal cavity containing a plurality of consumable products and a divider wall that separates the internal cavity into a main compartment and a dispensing compartment, the divider wall comprising an opening that forms a passageway from the main compartment into the dispensing compartment; a cover member comprising an outlet wall having a dispensing opening and a stopper wall having a pass-through opening, wherein the cover member is slidably coupled to the housing with the stopper wall of the cover member adjacent to the divider wall of the housing, and wherein the cover member is slidable relative to the housing between: (1) a closed state in which: (a) the pass-through opening of the stopper wall of the cover member is aligned with the opening of the divider wall of the housing to allow at least one of the plurality of consumable products to move from the main compartment to the dispensing compartment; and (b) the dispensing opening of the outlet wall is blocked by the housing to prevent any of the consumable products from being dispensed from the internal cavity; and (2) an open state in which: (a) the dispensing opening of the outlet wall is exposed to allow the at least one of the plurality of consumable products located within the dispensing compartment to be dispensed from the internal cavity; and (b) the pass-through opening of the cover member is not aligned with the opening of the divider member thereby preventing any additional ones of the plurality of consumable products from moving from the main compartment into the dispensing compartment while the cover member is in the open state.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

Figure 1:
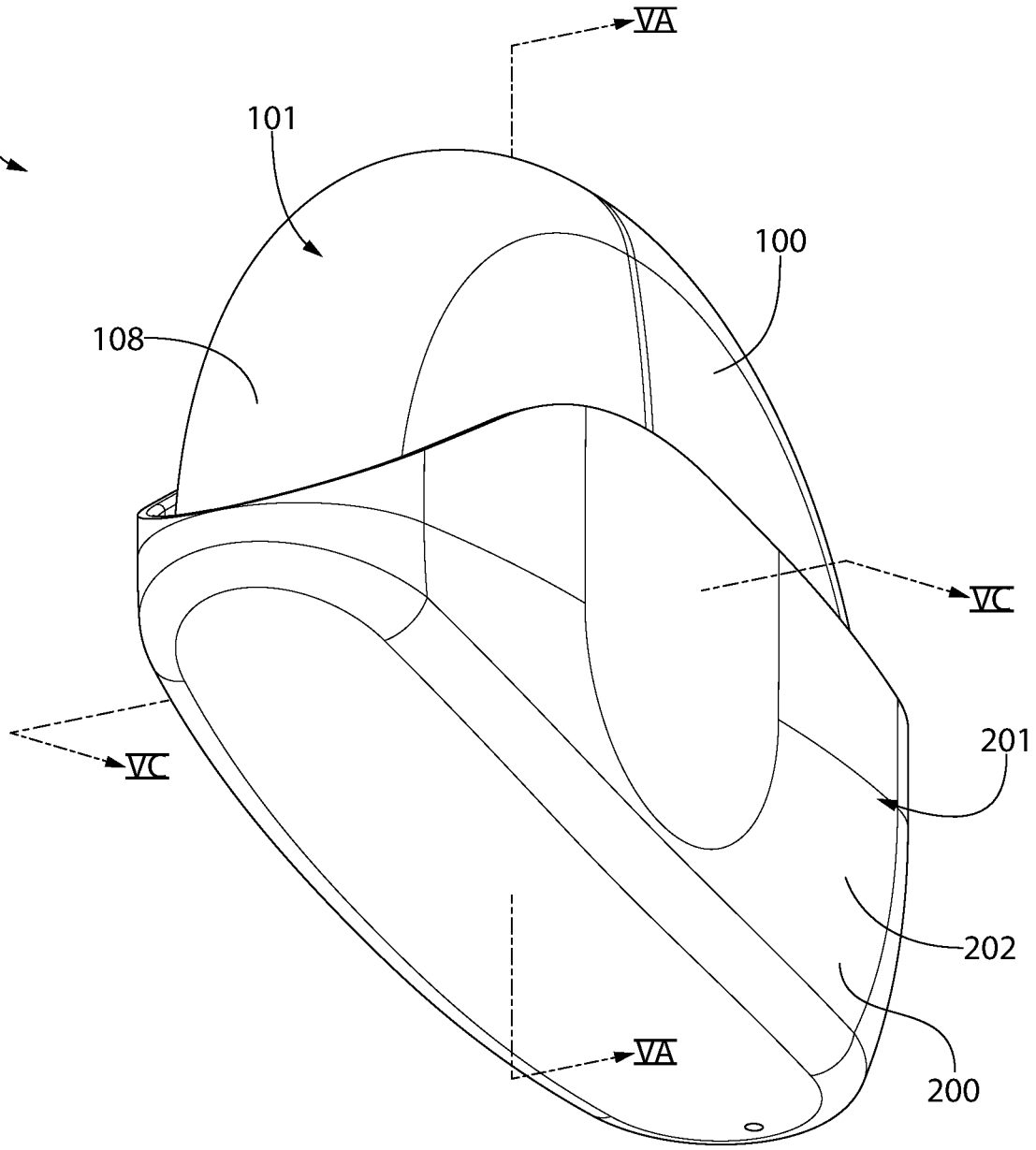
FIG. 1 is a front perspective view of a dispenser in accordance with an embodiment of the present invention, with a second component of the dispenser in a closed state.

The following description of the preferred embodiment(s) is merely exemplary in nature and is in no way intended to limit the invention, its application, or uses.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

Figure 2:
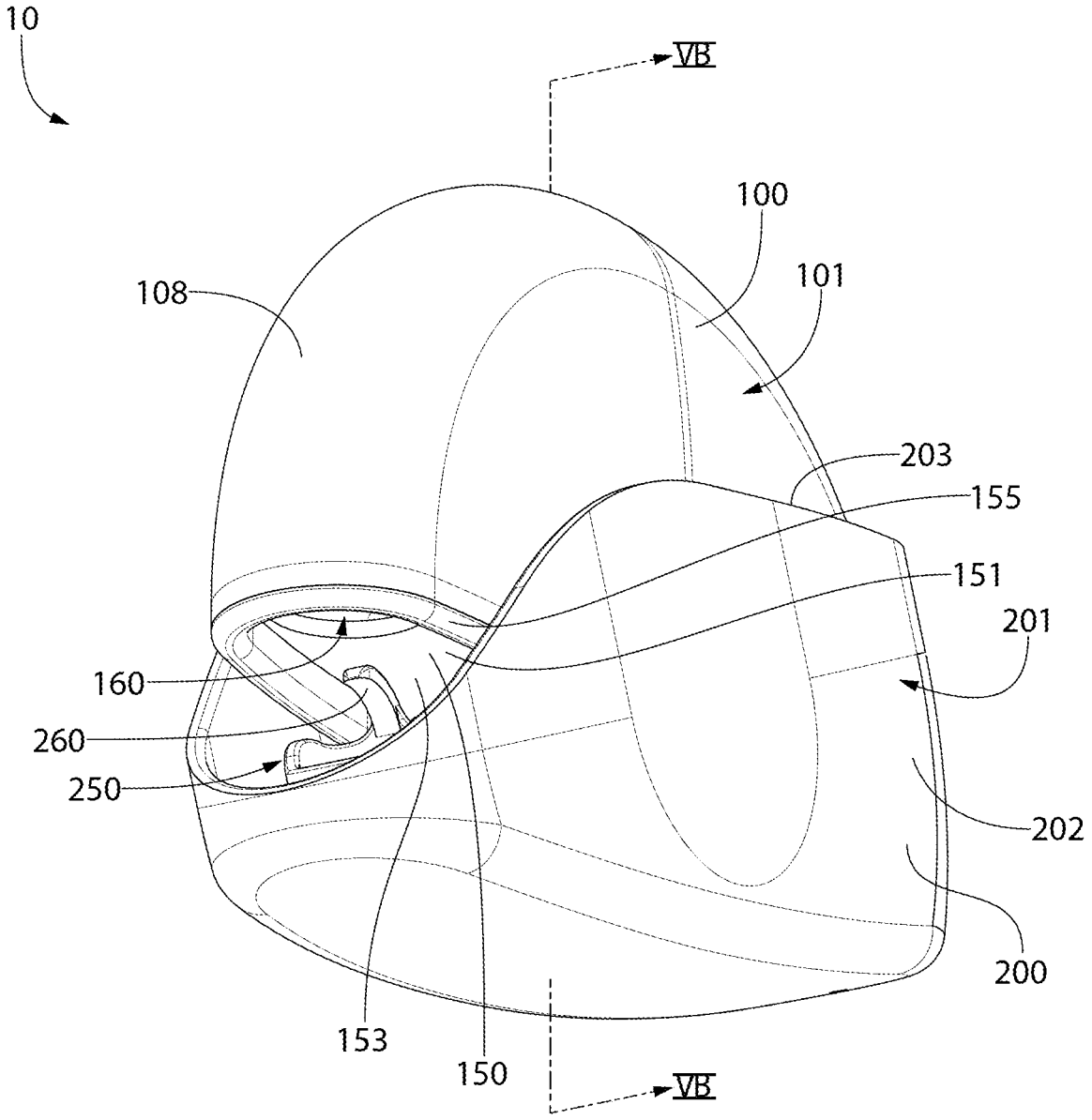
FIG. 2 is a front perspective view of the dispenser of FIG. 1 with the second component in an open state.
Figure 3:
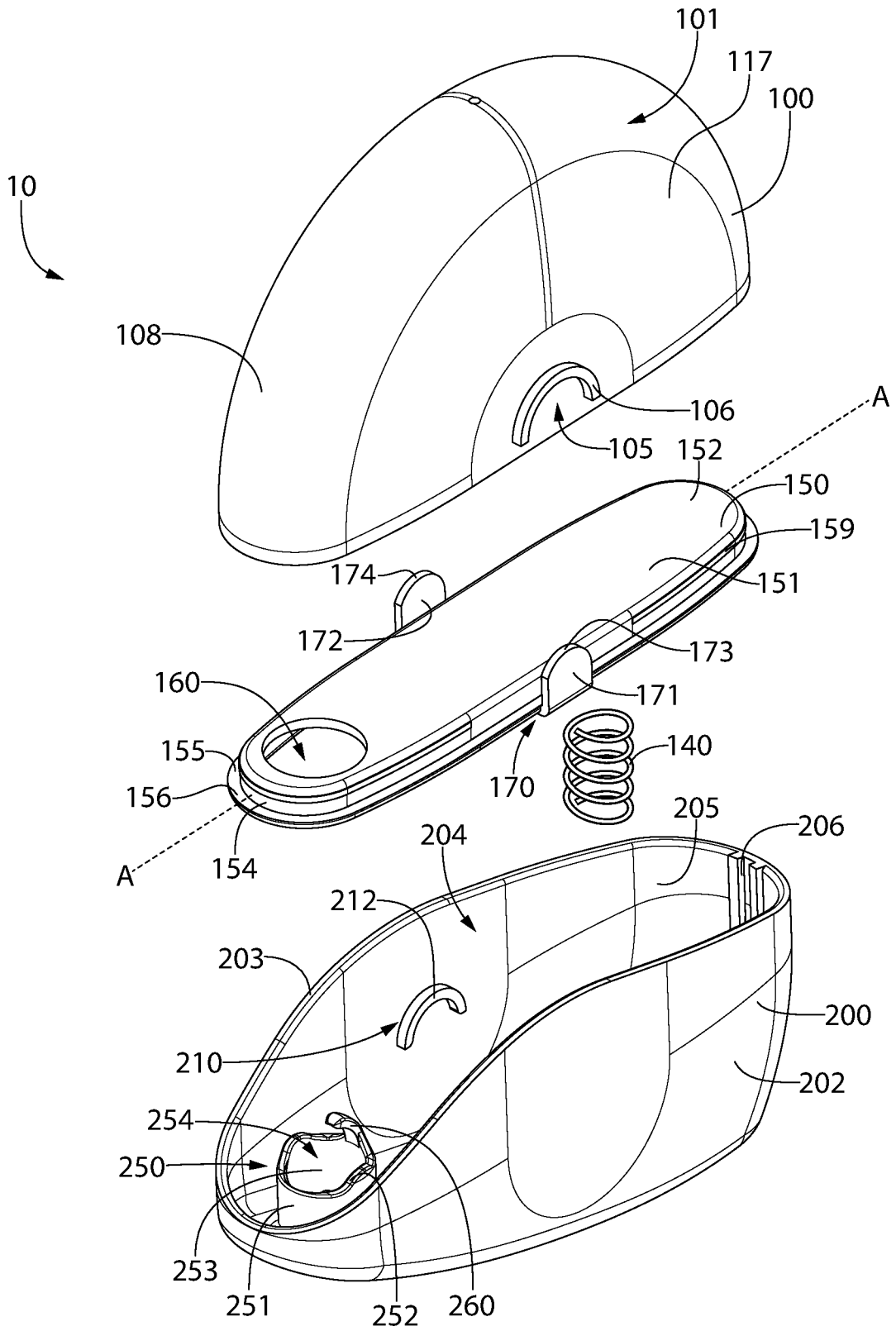
FIG. 3 is an exploded top front perspective view of the dispenser of FIG. 1.
Figure 4:
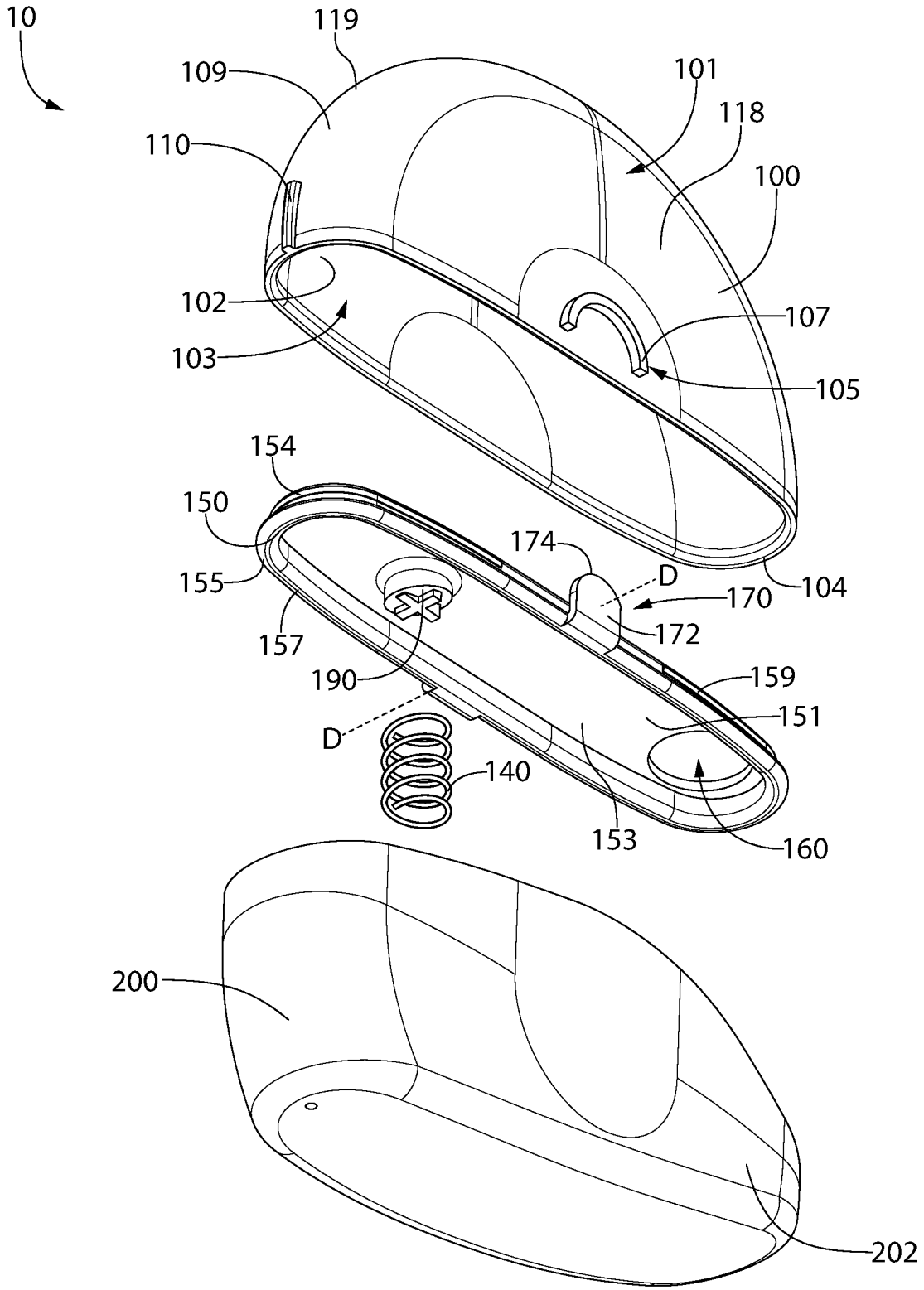
FIG. 4 is an exploded bottom front perspective view of the dispenser of FIG. 1.
Figure 5A:
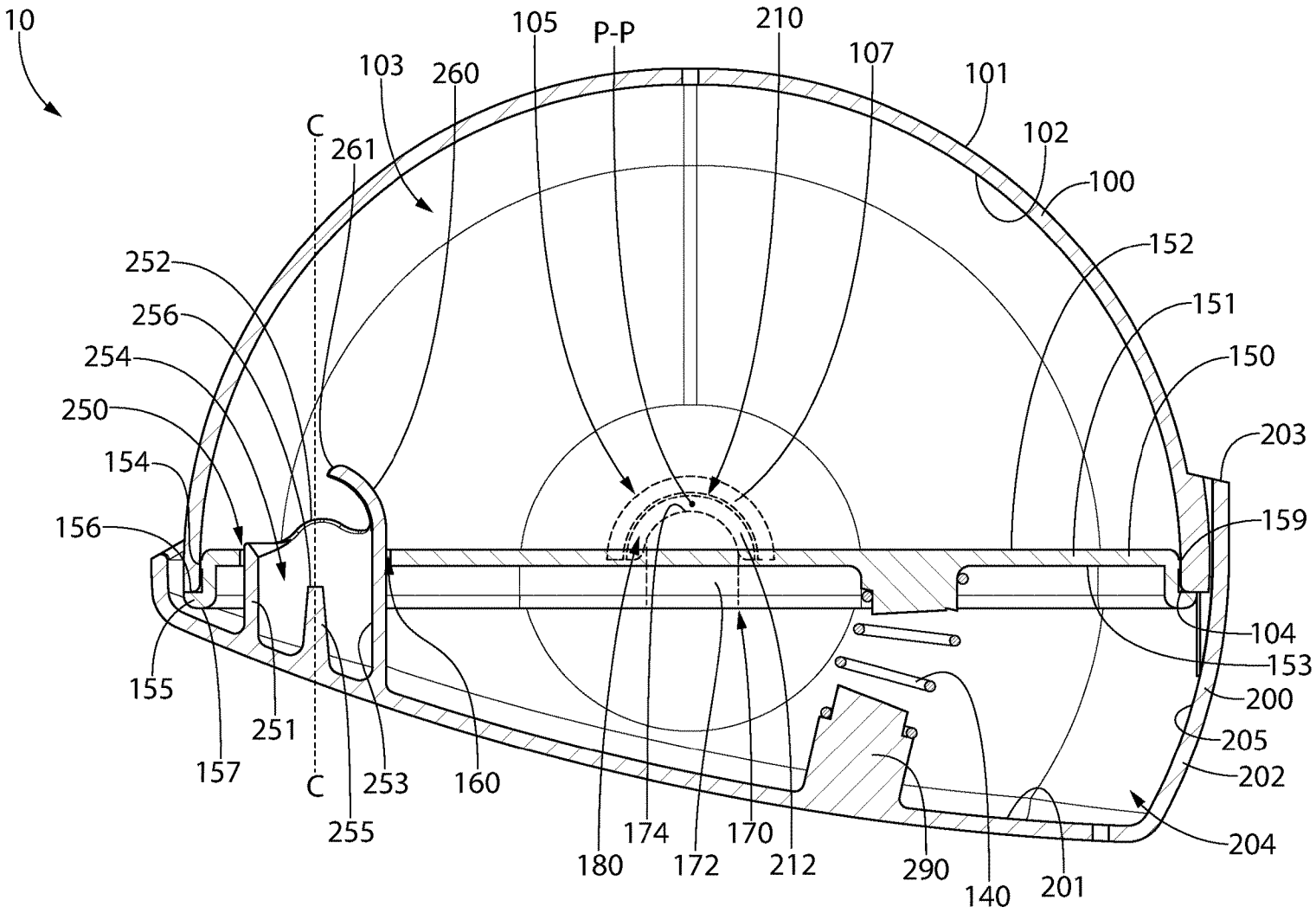
FIG. 5A is a cross-sectional view taken through line VA-VA of FIG. 1.
Figure 5B:
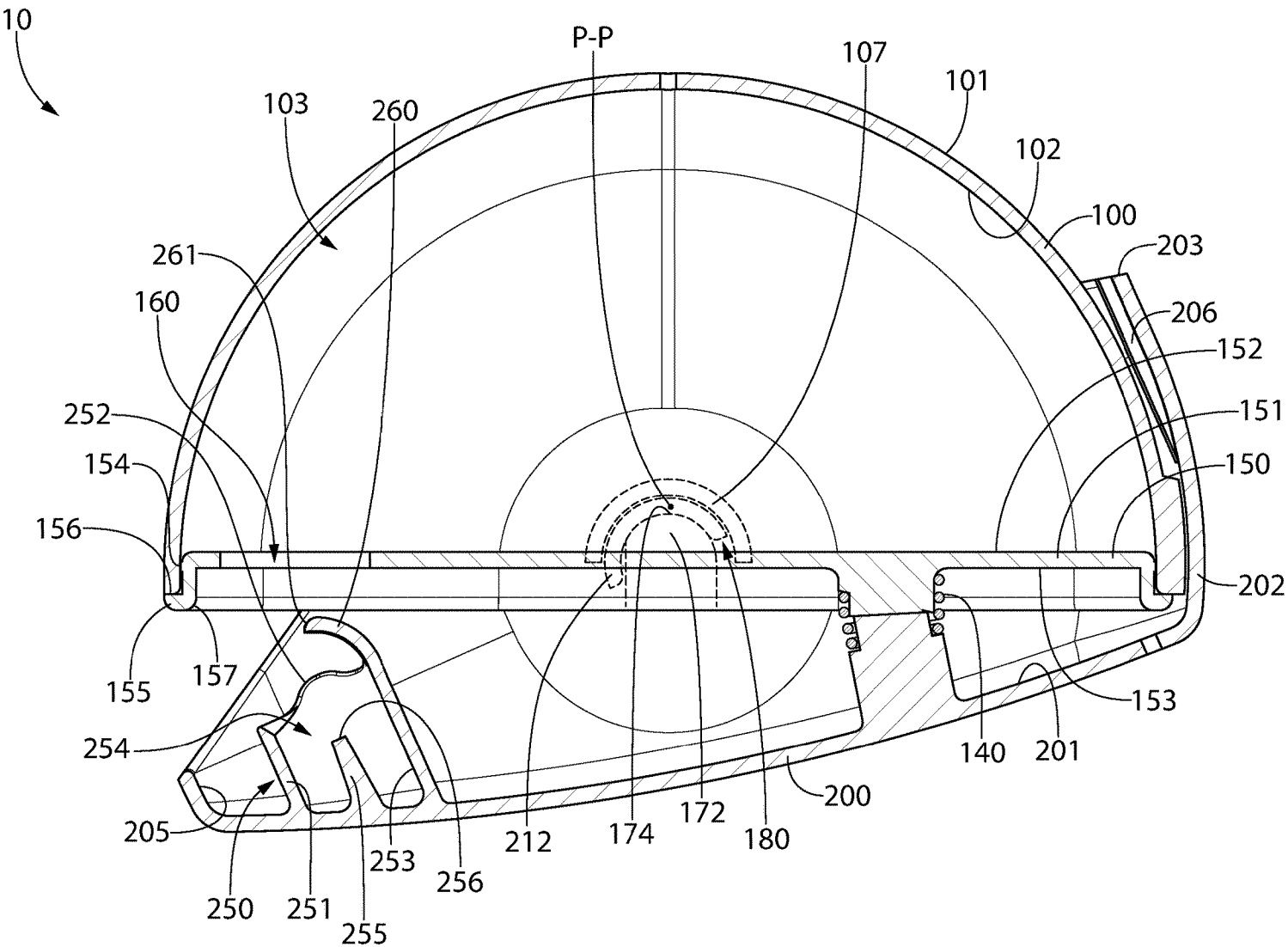
FIG. 5B is a cross-sectional view taken through line VB-VB of FIG. 2.

Referring first to FIGS. 1-5B, a dispenser 10 is illustrated in accordance with an embodiment of the present invention. The dispenser 10 generally comprises a first component 100, a second component 200, and a closure member 150 that are cooperatively coupled together so that the dispenser 10 is configured to dispense one consumable product each time the second component 200 is altered from a closed state to an open state, as described further herein. The first component 100 may also be referred to herein as a storage component and the second component 200 may also be referred to herein as a dispenser component. Moreover, while the closure member 150 is separate from the first component 100 in the exemplified embodiment, the invention is not to be so limited and the closure member 150 could be an integral part of the first component 100 in some embodiments. FIGS. 1 and 5A illustrate the second component 200 (or the dispenser 10) in the closed state and FIGS. 2 and 5B illustrate the second component 200 (or the dispenser 10) in the open state. The first component 100, the second component 200, and the closure member 150 may each be formed from a hard plastic material in some embodiments. Moreover, in some embodiments the first component 100 may be translucent or transparent so that the consumable products held therein are visible to a user. In some embodiments, the first component 100 and the second component 200 may be translucent or transparent. In some embodiments, the closure member 150 may also be transparent or translucent.

In the exemplified embodiment, the first component 100 is in the shape of a half oblate spheroid that has been cut by a plane extending though its main faces at a midpoint thereof. The first component 100 comprises an outer surface 101, an inner surface 102, and a storage cavity 103 that is defined by the inner surface 102. The storage cavity 103 has an open end 104. In the exemplified embodiment, the open end 104 is located along the bottom end of the first component 100 based on the orientation thereof during normal use. The storage cavity 103 is configured to contain a plurality of consumable products, which are then dispensed from the storage cavity 103 by a user as desired. The dispensing of the consumable products will be described in greater detail below with reference to FIGS. 6A-6E. In the assembled dispenser 10, the first component 100 is generally oriented so that the open end 104 of the storage cavity 103 faces downwardly during use thereof.

The first component 100 comprises a first planar side portion 117, a second planar side portion 118, and a curved central portion 119 between the first and second planar side portions 117, 118. The inner surface 102 of the first component 100 along the curved central portion 119 forms a floor of the storage cavity 103. The inner surface 102 of the first component 100 along the first and second planar side portions 117, 118 forms a sidewall of the storage cavity 103.

The first component 100 comprises a first pivot feature 105 that facilitates the pivoting of the first and second components 100, 200 relative to one another. In the exemplified embodiment, the first pivot feature 105 comprises a first arcuate protrusion 106 protruding from a first side of the first component 100 and a second arcuate protrusion 107 protruding from a second side of the first component 100. Specifically, the first arcuate protrusion 106 is located on the outer surface 101 of the first component 100 along the first planar side portion 117 and the second arcuate protrusion 107 is located on the outer surface 101 of the first component 100 along the second planar side portion 118. In the exemplified embodiment, the first and second arcuate protrusions 106, 107 have concave surfaces that face in a direction towards the open end 104 of the storage cavity 103 and convex surfaces that face in a direction away from the open end 104 of the storage cavity 103. Although the first pivot feature 105 is described as comprising the first and second arcuate protrusions 106, 107 in the exemplified embodiment, other features may be used in other embodiments, one example of which will be provided below with reference to FIGS. 7-10C. In still other embodiments, the first pivot feature 105 may be one of a hole or a cylindrical protrusion that nests within the hole (specifically, one of the first and second components 100, 200 may have a hole and the other may have a protrusion that nests within the hole) to allow for the relative pivoting/rotational movement between the first and second components 100, 200 as described herein.

The first component 100 comprises a front end (or front portion) 108 and a rear end (or rear portion) 109. The front end 108 of the first component 100 is the end from which the consumable products are dispensed from the dispenser 10 and the rear end 109 is the end that is opposite the front end 108. In the exemplified embodiment, the first component 100 comprises a ridge 110 protruding from the outer surface 101 along the rear end 109 thereof. In particular, the ridge 110 is elongated and extends from a first end that is adjacent to the open end 104 of the storage cavity 103 to a second end that is located at a distance from the open end 104 of the storage cavity 103. As will be discussed in greater detail below, the ridge 110 cooperates with a slot in the second component 200 to maintain the coupling between the first and second components 100, 200 and prevent over-rotation of the second component 200 relative to the first component 100.

In the exemplified embodiment, the cover member 150 is a component that is separate and distinct from each of the first and second components 100, 200. However, the invention is not to be so limited and in other embodiments the cover member 150 may be formed integrally with the first or second components 100, 200 as a single unitary construct. In the exemplified embodiment, the cover member 150 is coupled to the first component 100 in such a manner that the cover member 150 closes the open front end 108 of the first component 100. The cover member 150 comprises a body portion 151 comprising an inner surface 152, an outer surface 153, and a peripheral surface 154 extending between the inner and outer surfaces 152, 153. The cover member 150 also comprises a flange portion 155 that extends radially outward from the peripheral surface 154 at a position that is adjacent to the outer surface 153. The flange portion 155 comprises an inner surface 156 and an outer surface 157. The inner surface 152 of the body portion 151 is elevated relative to the inner surface 156 of the flange portion 155 and the outer surface 153 of the body portion 151 is recessed relative to the outer surface 157 of the flange portion 155. When the cover member 150 is coupled to the first component 100, the body portion 151 of the cover member nests within the storage cavity 103 and spans across an entirety of the length and width of the storage cavity 103 of the first component 100 and the flange portion 155 covers a distal end of the first component 100. More particularly, the inner surface 156 of the flange portion 155 abuts against the distal end of the first component 100.

In the exemplified embodiment, the cover member 150 is coupled to the first component 100 using a friction fit such that the peripheral surface 154 of the body portion 151 of the cover member 150 fits tightly against the inner surface 102 of the first component 100 to create a snug fit between the cover member 150 and the first component 100. As shown in the exemplified embodiment, the cover member 150 may comprise a sealing member 159 protruding from the peripheral surface 154 to ensure that the cover member 150 is in positive contact with the inner surface 102 of the first component 100 for purposes of achieving an adequate seal between those two components. This tight fit or friction fit between the cover member 150 and the first component 100 creates a seal at the interface between the cover member 150 and the first component 100. A more permanent attachment between the first component 100 and the cover member 150 may be achieved using adhesives or hardware such as screws, nails, or bolts. However, the tight fit or friction fit engagement as noted herein may be desirable in some embodiments to allow a user to readily detach the cover member 150 from the first component 100 as needed to refill the storage cavity 103 with the consumable products. In some embodiments, the coupling between the cover member 150 and the first component 100 may be a snap-fit connection.

In some embodiments, a gasket or sealing ring may be coupled to the cover member 150 along one or both of the inner surface 156 of the flange portion 155 and the peripheral surface 154 of the body portion 151 to create an air-tight and hermetic seal between the cover member 150 and the first component 100. In some embodiments, the cover member 150 and/or the first component 100 may include snap-over features or other connection features which facilitate the coupling between the cover member 150 and the first component 100. For example, one of the cover member 150 and the first component 100 may include protrusions which nest within receiving apertures or recesses formed into the other of the cover member 150 and the first component 100.

The cover member 150 comprises a dispensing aperture 160 extending through the body portion 151 of the cover member 150 from the upper surface 152 of the body portion 151 to the lower surface 153 of the body portion 151. Thus, the dispensing aperture 160 forms a passageway that allows the consumable products to exit the storage reservoir 103 during dispensing as described in greater detail below. In the exemplified embodiment, the dispensing aperture 160 is in the shape of a circle, although the invention is not to be so limited in all embodiments. The dispensing aperture 160 is preferably of a size and shape (i.e., a diameter or other dimension) that permits no more than one of the consumable products to be dispensed from the storage reservoir 103 through the dispensing aperture 160 at a time. This facilitates operation of the dispenser 10 as a single dose dispenser such that the dispenser 10 only dispenses one of the consumable products at a time. Of course, it may be possible to alter the size and shape of the dispensing aperture 160 or the size and shape of the consumable products to allow more than one of the consumable products to fit therethrough in some alternative embodiments, for example where a single dose comprises more than one of the consumable products.

The cover member 150 also comprises a third pivot feature 170. In the exemplified embodiment, the third pivot feature 170 comprises a first tab 171 protruding upwardly from the flange portion 155 of the cover member 150 on a first side of the cover member 150 and a second tab 172 protruding upwardly from the flange portion 155 of the cover member 150 on a second side of the cover member 150. Stated another way, the cover member 150 extends along a longitudinal axis A-A and the first and second tabs 171, 172 are located on opposite sides of the longitudinal axis A-A of the cover member 150. The first tab 171 terminates in a first arcuate distal surface 173 and the second tab 172 terminates in a second arcuate distal surface 174.

As best shown in FIGS. 5A and 5B, when the cover member 150 is coupled to the first component 100, the first tab 171 of the cover member 150 is aligned with the first arcuate protrusion 106 of the first component 100 and the second tab 172 of the cover member 150 is aligned with the second arcuate protrusion 107 of the first component 100. Only the second tab 172 and the second arcuate protrusion 107 are visible in the cross-sectional views provided, but it should be appreciated that the same structural relationship exists between the first tab 171 and the first arcuate protrusion 106. The second tab 172 is positioned so that the arcuate distal surface 174 thereof is spaced apart from the concave lower surface of the second arcuate protrusion 107 by a gap 180. The gap 180 is arcuate shaped with a downward facing concave surface and an upward facing convex surface. The gap 180 forms a track within which a pivoting feature of the second component 200 nests and moves as the second component 200 transitions between the open and closed states, as discussed further below.

The second component 200 is coupled to the first component 100 and/or the cover member 150 to form an enclosed housing that is configured for dispensing the consumable products one at a time as described in greater detail below with reference to FIGS. 6A-6E. The second component 200 comprises a floor 201 and a sidewall 202 that extends upwardly from the floor 201 to a distal end 203. The sidewall 202 has a varying height such that the distal end 203 is not planar. Rather, along a rear portion of the second component 200 the sidewall 202 has a constant height, and then moving from a central region of the second component 200 towards a front end of the second component 200 a height of the sidewall 202 decreases such that the distal end 203 is sloped downwardly. This allows for an opening to be formed between the first and second components 100, 200 as the second component 200 is altered from the closed state (FIGS. 1 and 5A) to the open state (FIGS. 2 and 5B).

The floor 201 and an inner surface 205 of the sidewall 202 collectively define an internal cavity 204 of the second component 200. As shown in FIGS. 5A and 5B, when the dispenser 10 is assembled, at least a portion of the first component 100 and the cover member 150 nest within the internal cavity 204 of the second component 200. The second component 200 comprises an elongated slot 206 along its inner surface 205 for receiving the ridge 110 of the first component 100 as described above. Thus, as the second component 200 moves between the open and closed states, the ridge 110 of the first component 100 slides within the elongated slot 206 of the second component 200 to prevent unwanted relative movement between the first and second components 100, 200. That is, while the first and second components 100, 200 can pivot relative to one another about a pivot axis P-P (labeled in) FIGS. 5A and 5B), there is minimal rotational movement between the first and second components along an axis that is perpendicular to the pivot axis P-P.

The second component 200 comprises a second pivot feature 210 that interacts with the first and third pivot features 105, 170 of the first component 100 and cover member 150 to facilitate the pivoting movement of the second component 200 relative to the first component 100 and the cover member 150. Specifically, the second pivot feature 210 comprises a first arcuate protrusion 211 (see FIG. 5C) protruding from the inner surface 205 of the sidewall 202 and a second arcuate protrusion 212 protruding from the inner surface 205 of the sidewall 202 on an opposite side of the second component 200. The first and second arcuate protrusions 212 comprise upwardly facing convex surfaces and downwardly facing concave surfaces. As shown in FIGS. 5A and 5B, when the dispenser 10 is assembled, the second arcuate protrusion 212 of the second pivot feature 210 nests within the gap 180 between the second arcuate protrusion 107 of the first pivot feature 105 and the arcuate distal end 174 of the second tab 172 of the third pivot feature 170 of the cover member 150. As the second component 200 pivots or rotates relative to the first component 100 and cover member 150, the second pivot feature 210 moves within the gap 180 between the first and third pivot features 105, 170. However, the second pivot feature 210 remains sandwiched between the first and third pivot features 105, 170, which facilitates to maintain the coupling between the various components.

The second component 200 also comprises a cup-shaped member (or holding member) 250 that protrudes from the floor 201. The cup-shaped member 250 is formed by an upstanding annular wall 251 which extends from the floor 201 to a distal end 252. It may be possible for the upstanding annular wall 251 to have gaps, although in the exemplified embodiment it is a continuous annular wall. The cup-shaped member 250 extends along a cup axis C-C. The upstanding annular wall 251 comprises an inner surface 253 that surrounds a holding cavity 254. Furthermore, there is a post 255 that extends upwardly from the floor 201 along the cup axis C-C. The post 255 terminates in a distal end 256 that is recessed relative to the distal end 252 of the upstanding annular wall 251. More specifically, in the exemplified embodiment the distal end 256 of the upstanding annular wall 251 is wavy or undulating, and the distal end 256 of the post 255 is recessed relative to a lowermost point of the distal end 252 of the upstanding annular wall 251. As shown in FIGS. 6A-6E and discussed below, the one of the consumable products that is caught within the holding cavity 254 rests atop of the distal end 256 of the post 255 to allow a user to easily grab the consumable product for removal and consumption.

The second component 200 comprises a blocker arm 260 that extends upwardly from the distal end 252 of the upstanding annular wall 251 in a direction away from the floor 201 of the second component 200. The blocker arm 260 extends along a portion of, but not the entirety of, the distal end 252 of the upstanding annular wall 251. That is, if the distal end 252 of the upstanding annular wall 251 spans 360°, the blocker arm 260 may extend along 10-20° of the 360° (of course the blocker arm 260 could extend along more or less of the distal end 252 in other embodiments). The blocker arm 260 extends upwardly from the distal end 252 of the upstanding annular wall 251 and inwardly in a direction towards the cup axis C-C so that the blocker arm 260 extends over the holding cavity 254. Thus, the blocker arm 260 hovers or is cantilevered over the holding cavity 254 so that there exist axes parallel to the cup axis C-C which intersect the blocker arm 260 and the holding cavity 254. The blocker arm 260 terminates at a distal end 261 that is aligned with the holding cavity 254.

In the exemplified embodiment, the blocker arm 260 is curved as it extends from the distal end 252 of the upstanding annular wall 251. In particular, in the exemplified embodiment the blocker arm 260 is curved so that it has a concave surface facing downwardly towards the holding cavity 254 and a convex surface facing upwardly away from the holding cavity 254. The blocker arm 260 may be linear and non-curved in other embodiments.

In the exemplified embodiment, the cover member 150 comprises a connection post 190 protruding from the outer surface 153 of the body portion 151 at a location that is spaced apart from the dispensing aperture 160. In particular, the connection post 190 and dispensing aperture 160 are located on opposite sides of a transverse centerline D-D of the cover member 150. Similarly, the second component 200 comprises a connection post 290 protruding upwardly from the floor 201 of the second component 200. In the exemplified embodiment, a spring 140 is coupled to the connection post 190 of the cover member 150 and to the connection post 290 of the second component 200. The purpose of the spring 140 is to bias the second component 200 into the closed state as shown in FIG. 5A. That is, when the second component 200 is altered into the open state as shown in FIG. 5B, the spring 140 is compressed, and upon release of the second component 200 the spring 140 exerts a force as it returns to its original length. While in the exemplified embodiment the spring 140 is a compression spring, in other embodiments the spring 140 may be a tension spring, a torsion spring, or even a plastic spring that is manufactured integrally with the second component 200 or the cover member 150. Moreover, while the spring 140 is depicted in the exemplified embodiment, the spring 140 could be omitted in other embodiments. In particular, in other embodiments the second component 200 may be altered from the closed state to the open state and then from the open state to the closed state manually without any assistance from a spring or other external component.

As mentioned above, FIGS. 1 and 5A illustrate the dispenser 10 with the second component 200 in the closed state. As can be seen, there is no opening into the dispenser when the second component 200 is in the closed state. FIGS. 2 and 5B illustrate the dispenser 10 with the second component 200 in the open state. To alter the second component 200 from the closed state to the open state, the second component 200 is pivoted relative to the first component 100 about the pivot axis P-P. This is achieved manually by a user in the exemplified embodiment, by holding the first component 100 in a fixed position and applying a pivoting force onto the second component 200. Once the second component 200 is in the open state, an opening into the dispenser 10 interior is exposed. As should be appreciated, if there were a consumable product on the cup-shaped member 250 (discussed below with reference to FIGS. 6A-6E), a user would then be able to grab the consumable product and remove it from the dispenser 10. Moreover, as can be seen in FIG. 5B, when the second component 200 is in the open state, the blocker arm 160 is not located within the dispensing aperture 160 or within the storage cavity 103. Rather, the blocker arm 160 is positioned below the cover member 150. However, the blocker arm 160 still serves to prevent additional ones of the consumable products from being dispensed through the dispensing aperture 160, as described in detail below with reference to FIGS. 6A-6E.

Figure 5C:
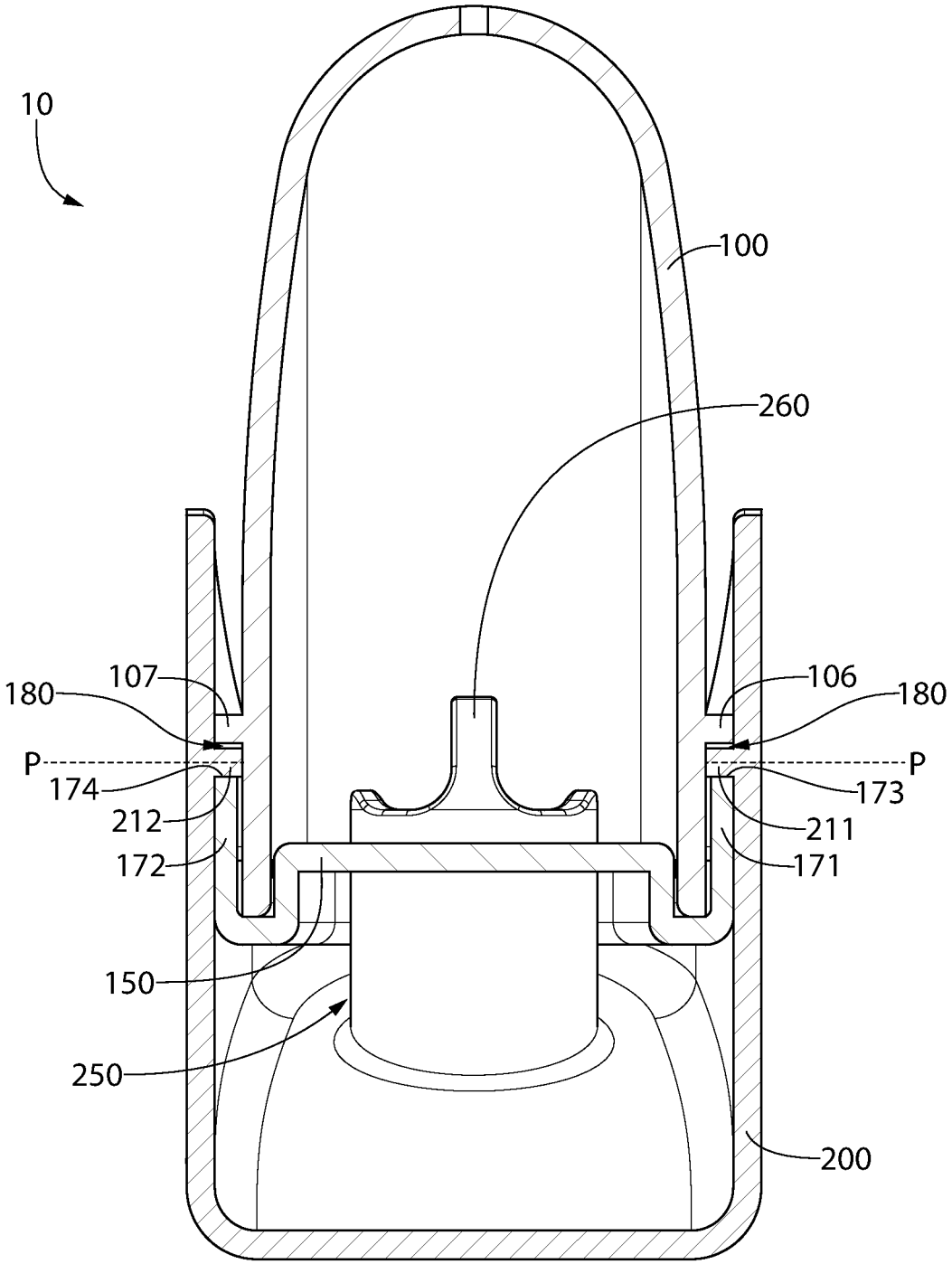
FIG. 5C is a cross-sectional view taken through line VC-VC of FIG. 1.

Referring briefly to FIG. 5C, the dispenser 10 is illustrated in cross-section with the cut being taken through the first, second, and third pivot features 105, 210, 170. As discussed above, the first arcuate protrusion 211 of the second pivot feature 205 of the second component 200 is sandwiched between the first arcuate protrusion 106 of the first pivot feature 105 of the first component 100 and the first arcuate distal surface 173 of the first tab 171 of the third pivot feature 170 of the cover member 150. Similarly, the second arcuate protrusion 212 of the second pivot feature 205 of the second component 200 is sandwiched between the second arcuate protrusion 107 of the first pivot feature 105 of the first component 100 and the second arcuate distal surface 174 of the second tab 172 of the third pivot feature 170 of the cover member 150. The second component 200 can pivot relative to the first component 100 about the pivot axis P-P, which results in the first and second arcuate protrusions 211, 212 of the second pivot feature 205 to slide/move within the gap 180 between the first and third pivot features 105, 170 of the first component 100 and the cover member 150, respectively.

Referring to FIGS. 6A-6E sequentially, operation of the dispenser 10 will be described in accordance with an embodiment of the present invention. As noted above, the dispenser 10 is configured to contain a plurality of consumable products 300 in the storage cavity 103 of the first component 100, and to dispense the consumable products 300 one at a time for consumption by a user. The consumable products 300 may take on various different forms, shapes, sizes, characteristics, formulas, and the like.

In the exemplified embodiment, the consumable products 300 comprise a dissolvable outer shell that surrounds an active agent. The dissolvable outer shell may be formed from polyvinyl alcohol or other dissolvable film materials. Moreover, the active agent may be a mouthwash or a toothpaste product when the consumable product 300 is intended for oral care. Thus, the consumable products 300 may be oral care products that are dispensed, one at a time, from the dispenser 10 and then inserted into the user's oral cavity to provide some benefit (fresh breath, anti-bacterial, saliva stimulation, sensitivity treatment, or the like). Where the consumable products 300 are toothpaste products, the consumable products 300 may be dispensed and then placed onto a toothbrush for use. Moreover, while the consumable products 300 are described herein as being used for oral care, the invention is not to be so limited and the consumable products 300 may take on other forms, including being soap products (one-time use or multi-use), acne treatment products, skin moisturizer products, sanitizer products, or the like. Moreover, the consumable product may include bath bombs and the like. In still other embodiments, the consumable products 300 may be chewing gum, mints, or the like. As used herein, the term consumable refers to any product that gets used up and decreases in size over time, and does not specifically require that the product be ingested. Moreover, the term product is merely intended to mean a small mass of material used for imparting a benefit to its user (a medicinal product, a mouthwash product, a toothpaste product, a moisturizing product, an acne treatment product, a sanitizing product, etc.).

Figure 6A:
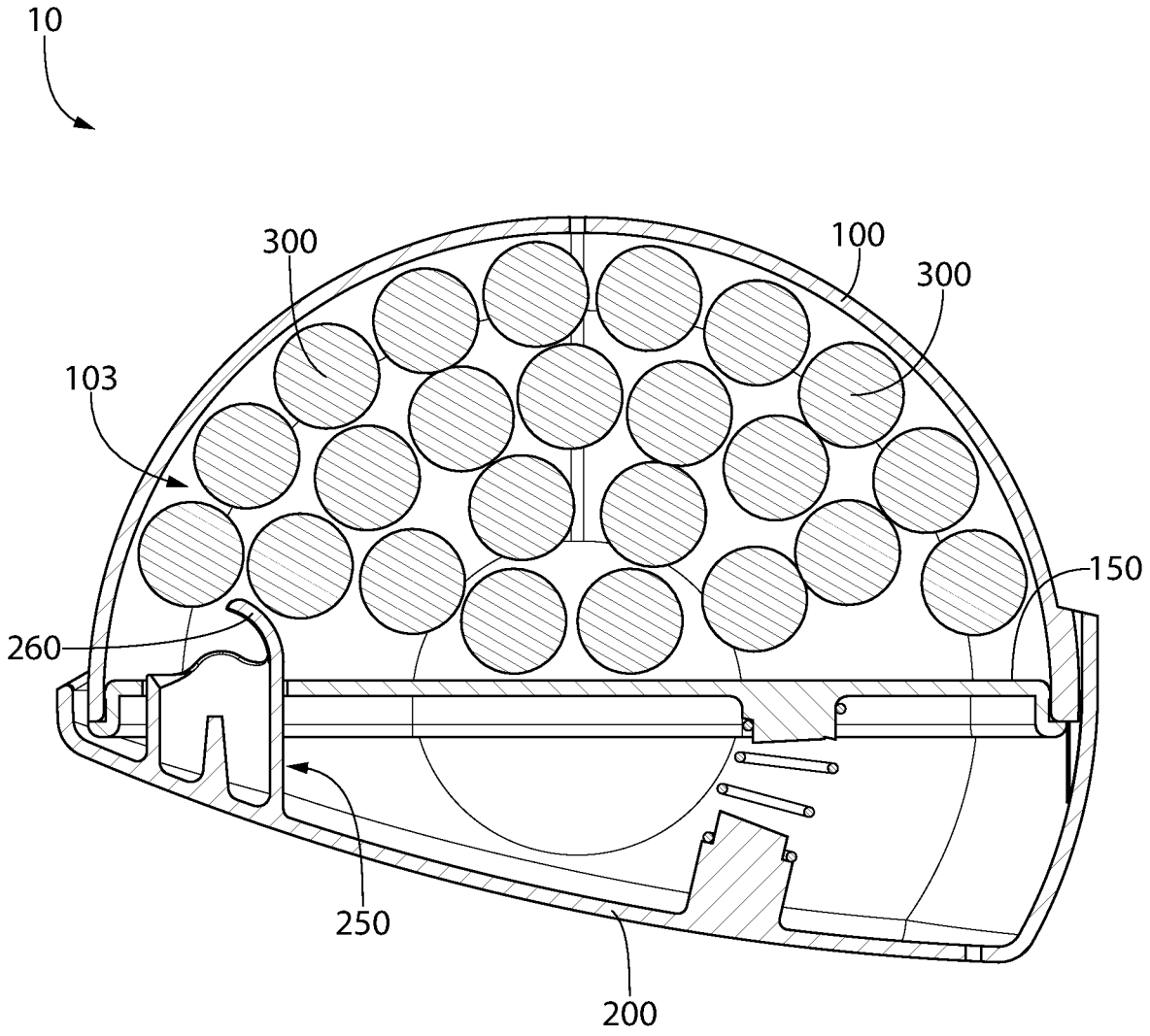
FIG. 6A is the cross-sectional view of FIG. 5A with the dispenser filled with consumable products.

In FIG. 6A, all of the consumable products 300 are located within the storage cavity 103 of the first component 100. Prior to altering the second component 200 from the closed state to the open state, a user should ensure that one of the consumable products 300 is being held by or otherwise located within the cup-shaped member 250 of the second component 200. Otherwise, if all of the consumable products 300 are located within the storage cavity 103, none will be dispensed when the dispenser 10 (or second component 200 thereof) is altered into the open state.

Figure 6B:
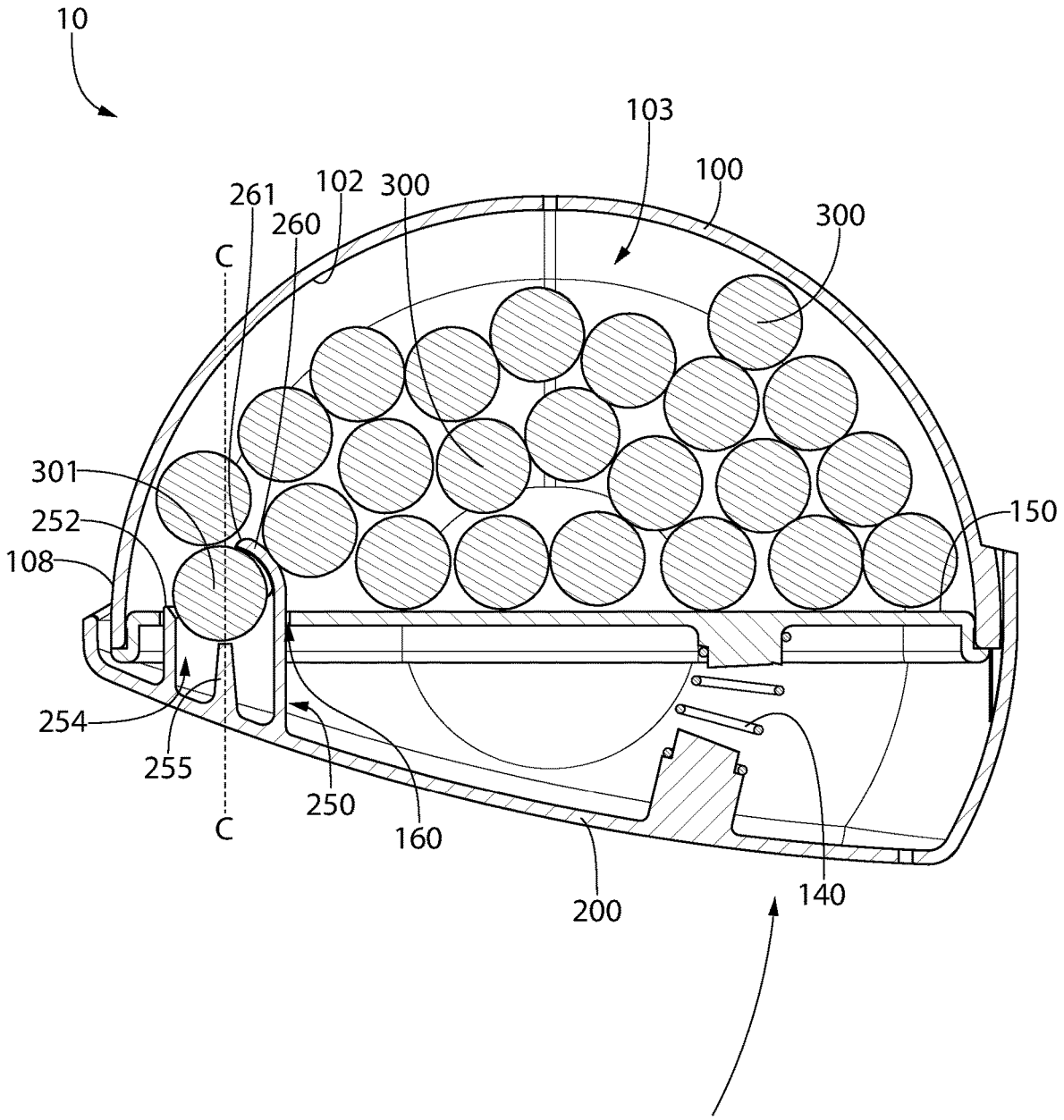
FIG. 6B is the cross-sectional view of FIG. 6A with one of the consumable products held by a cup-shaped member of the second component and with the second component in the closed state.

Referring to FIGS. 6A and 6B, in order to maneuver the consumable products 300 to ensure that one of the consumable products 300 is held by the cup-shaped member 250, a user may need to tilt or gently shake or rotate the dispenser 10. In some instances, simply holding the dispenser 10 in the orientation shown in FIGS. 6A and 6B will cause one of the consumable products 300 to become held by the cup-shaped member 250. FIG. 6B illustrates the dispenser 10 with a plurality of the consumable products 300 located within the storage cavity 103 of the first component 100 and one of the consumable products 301 being held by the cup-shaped member 250 of the second component 200. When the one of the consumable products 301 is located within the cup-shaped member 250, the post 255 ensures that the one of the consumable products 301 is elevated within the holding cavity 254 of the cup-shaped member 250. Furthermore, the blocker arm 260 wraps partially around the one of the consumable products 301 to hold it in place within the holding cavity 254 of the cup-shaped member 250. The holding cavity 254 of the cup-shaped member 250 is only large enough to hold one of the consumable products 300 therein, and thus as shown in FIG. 6B additional ones of the consumable products 300 remain located within the storage cavity 103 of the first component 100 of the dispenser 10.

As discussed above, when the second component 200 is in the closed state, a portion of the cup-shaped member 250 nests within the dispensing aperture 160 of the cover member 150. Thus, the consumable products 300 are unable to simply fall through the dispensing aperture 160 but instead can only enter into the holding cavity 254 of the cup-shaped member 250. Furthermore, the blocker arm 260 is attached to the cup-shaped member 250 along a portion of the cup-shaped member 250 that is located furthest from the front end 108 of the first component 100 (which is also the front end of the dispenser 10). The blocker arm 260 extends upwardly from the distal end 252 of the cup-shaped member 250 and inwardly towards the cup axis C-C and also towards the front end 108 of the first component 100. The blocker arm 250 covers or wraps around a portion of the one of the consumable products 301 that is being held by the cup-shaped member 250. The space between the distal end 261 of the blocker arm 260 and the inner surface 102 of the first component 100 is sufficiently small such that only one of the consumable products 300 can fit between the distal end 261 of the blocker arm 260 and the inner surface 102 of the first component 100 at a time.

Figure 6C:
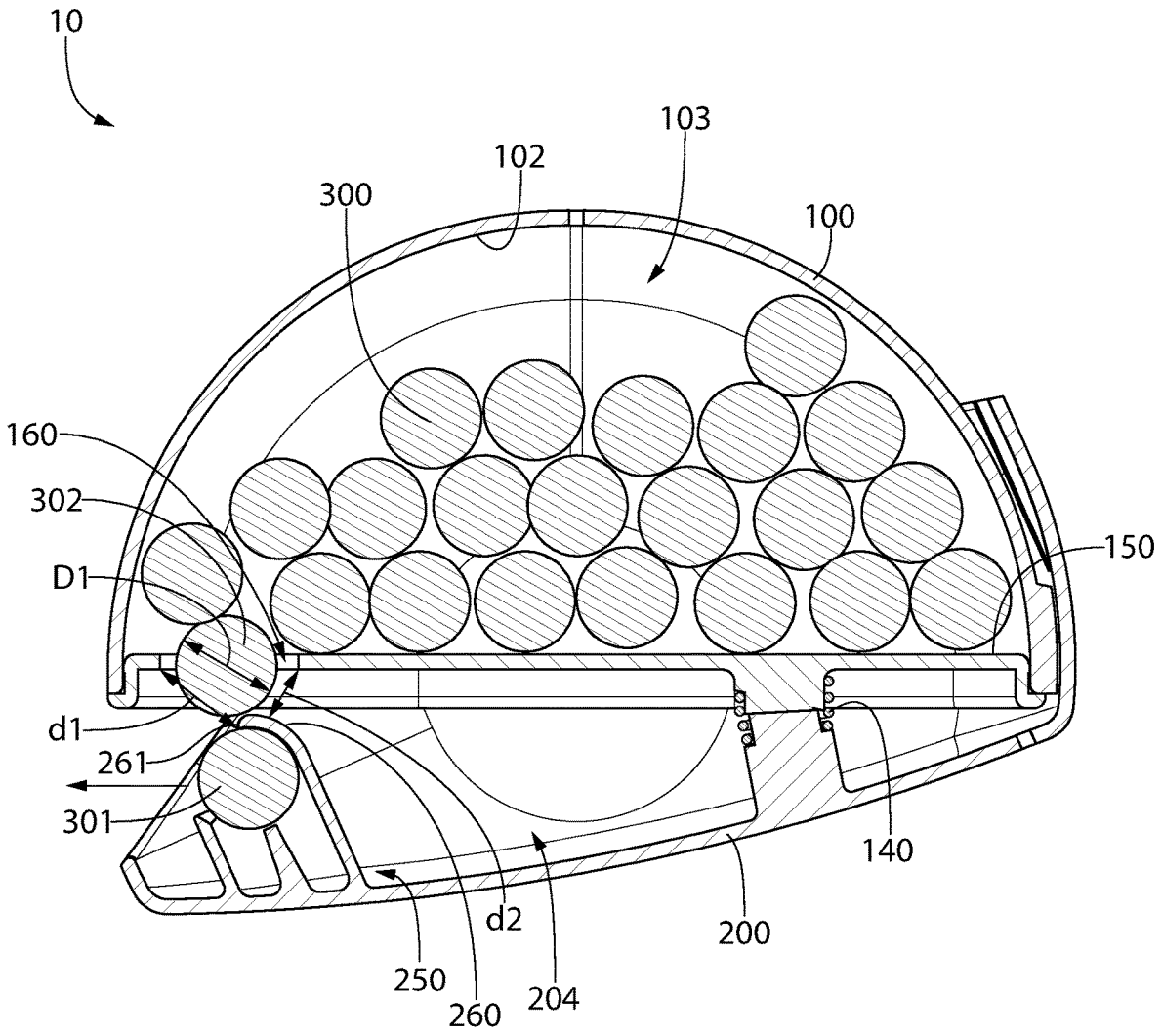
FIG. 6C is the cross-sectional view of FIG. 6B with the second component having been altered from the closed state to the open state so that the consumable product within the cup-shaped member can be dispensed to an external environment.

Next, referring to FIGS. 6B and 6C, a user can manually alter the second component 200 from the closed state (FIG. 6B) to the open state (FIG. 6C). This is achieved by pivoting or rotating the second dispenser 200 relative to the first dispenser 100 about the pivot axis. In doing so, the spring 140 compresses in the exemplified embodiment. As noted above, the spring 140 may be omitted in other embodiments. Pivoting the second component 200 relative to the first component 100 into the open state causes the front end or front portion of the second component 200 to pivot away from the front end or front portion of the first component 100 to create an opening at the front of the dispenser 10 through which a user can grip the one of the consumable products 301 for removal from the cup-shaped member 250.

Once the dispenser 10, or the second component 200 thereof, has been altered into the open state, a user can insert his or her fingers into the opening of the dispenser 10 to grab the one of the consumable products 301 to dislodge it from the cup-shaped member 250 and remove the one of the consumable products 301 from the dispenser 10 for use. Specifically, the user may grip the one of the consumable products 301 and pull it away from the cup-shaped member 250 for dispensing. Thus, in the exemplified embodiment, after the second component 200 is altered into the open state, the one of the consumable products 301 remains in the holding cavity of the cup-shaped member 250. That is, the one of the consumable products 301 is not dispensed from the dispenser 10 simply by altering it into the open state, but rather this just exposes the cup-shaped member and the one of the consumable products 301 to the user so that the user can grab the one of the consumable products 301 for consumption. In other embodiments, the act of altering the second component 200 from the closed state to the open state may cause the one of the consumable products 301 to become dislodged from the cup-shaped member 250 and thereby automatically dispensed. However, this is not the preferred embodiment because this may result in the one of the consumable products 301 falling onto the floor or some other undesirable, unhygienic location.

As seen in FIG. 6C, when the second component 200 is in the open state, the cup-shaped member 250 and the blocker arm 260 are removed from the dispensing aperture 160 of the cover member 150. Thus, a second one of the consumable products 302 is able to enter into the dispensing aperture 160. However, the second one of the consumable products 302 is unable to pass entirely through the dispensing aperture 160 for removal from the storage cavity 103. That is, there is insufficient space between the blocker arm 260 and the dispensing aperture 160 for the second one of the consumable products 302 to fit through. Thus the blocker arm 260 prevents the second one of the consumable products 302 from being dispensed from the storage cavity 103. Stated another way, a diameter D1 of the second one of the consumable products 302 (and each of the consumable products 300 in the storage cavity 103) is greater than a distance d1 between the distal end 262 of the blocker arm 260 and the inner surface 102 of the first component 100. The diameter D1 of the consumable products 300 is also greater than a distance d2 measured between the dispensing aperture 160 and a backside of the blocker arm 260, thereby preventing the consumable products 300 from passing into the into the internal cavity 204 of the second component 200. While the second one of the consumable products 302 may extend partially though the dispensing aperture 160, it cannot fit fully through the dispensing aperture 160 for dispensing due to the existence and positioning of the blocker arm 260.

Figure 6D:
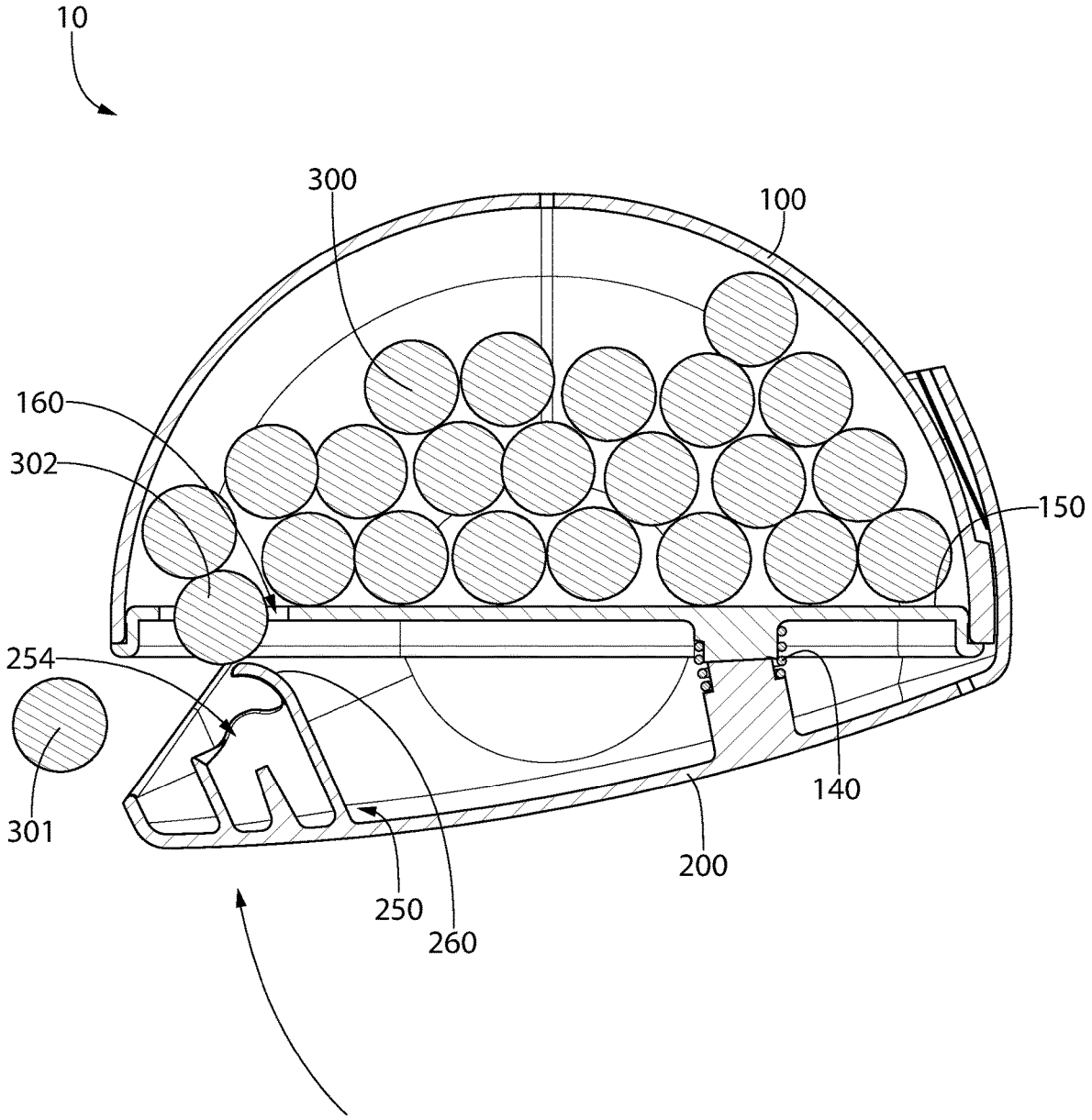
FIG. 6D is the cross-sectional view of FIG. 6C illustrating the consumable product being dispensed to the external environment.

FIG. 6D merely illustrates the one of the consumable products 301 having been removed from the cup-shaped member 250 and hence also from the dispenser 10 such that the one of the consumable products 301 has been dispensed to the exterior environment. The user can then consume the consumable product, either via insertion into the user's mouth or through other uses depending on the type of product.

Figure 6E:
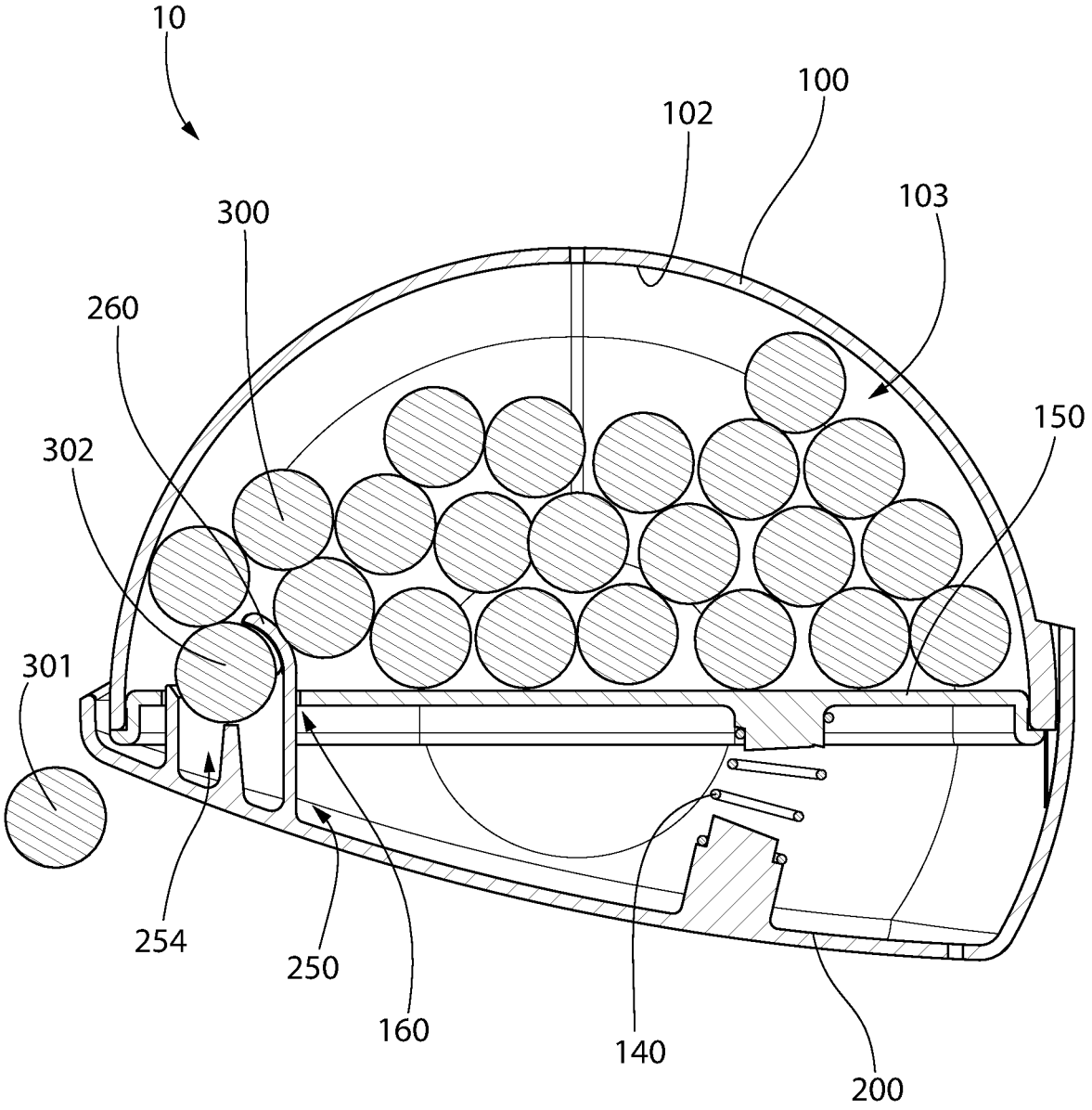
FIG. 6E is the cross-sectional view of FIG. 6D with the second component having been altered from the open state to the closed state so that another one of the consumable products can move from the storage cavity of the first cavity of the first component into the cup-shaped member of the second component.
Figure 7:
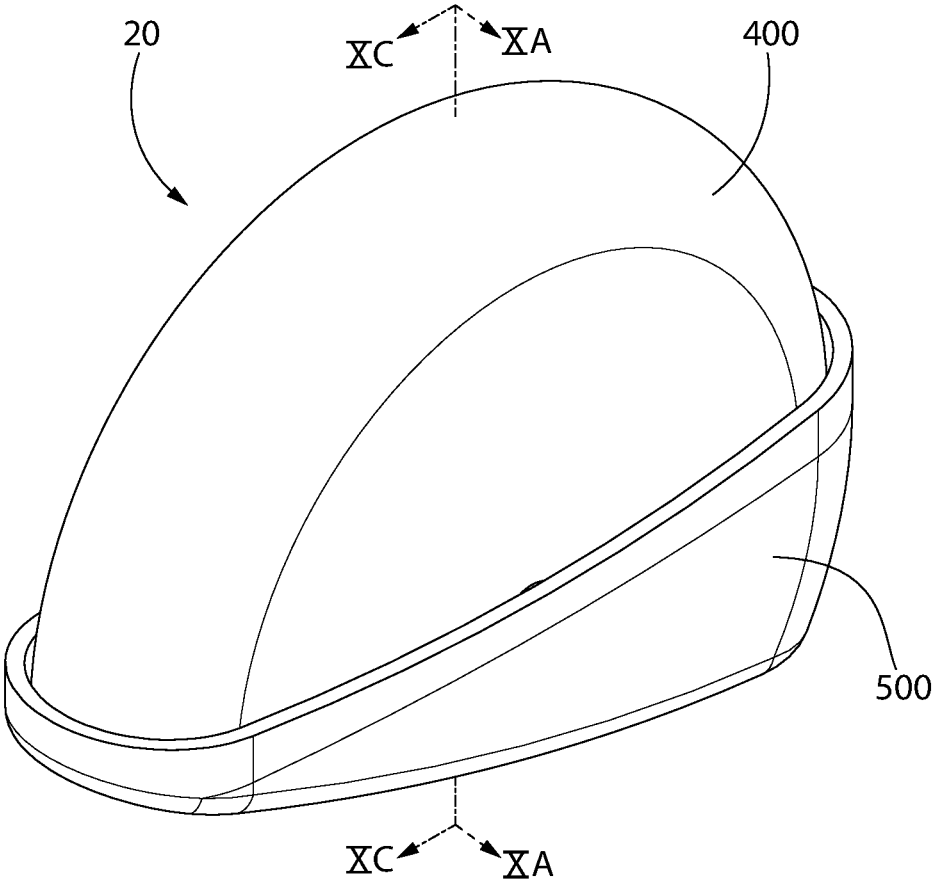
FIG. 7 is a front perspective view of a dispenser in accordance with another embodiment of the present invention.
Figure 8:
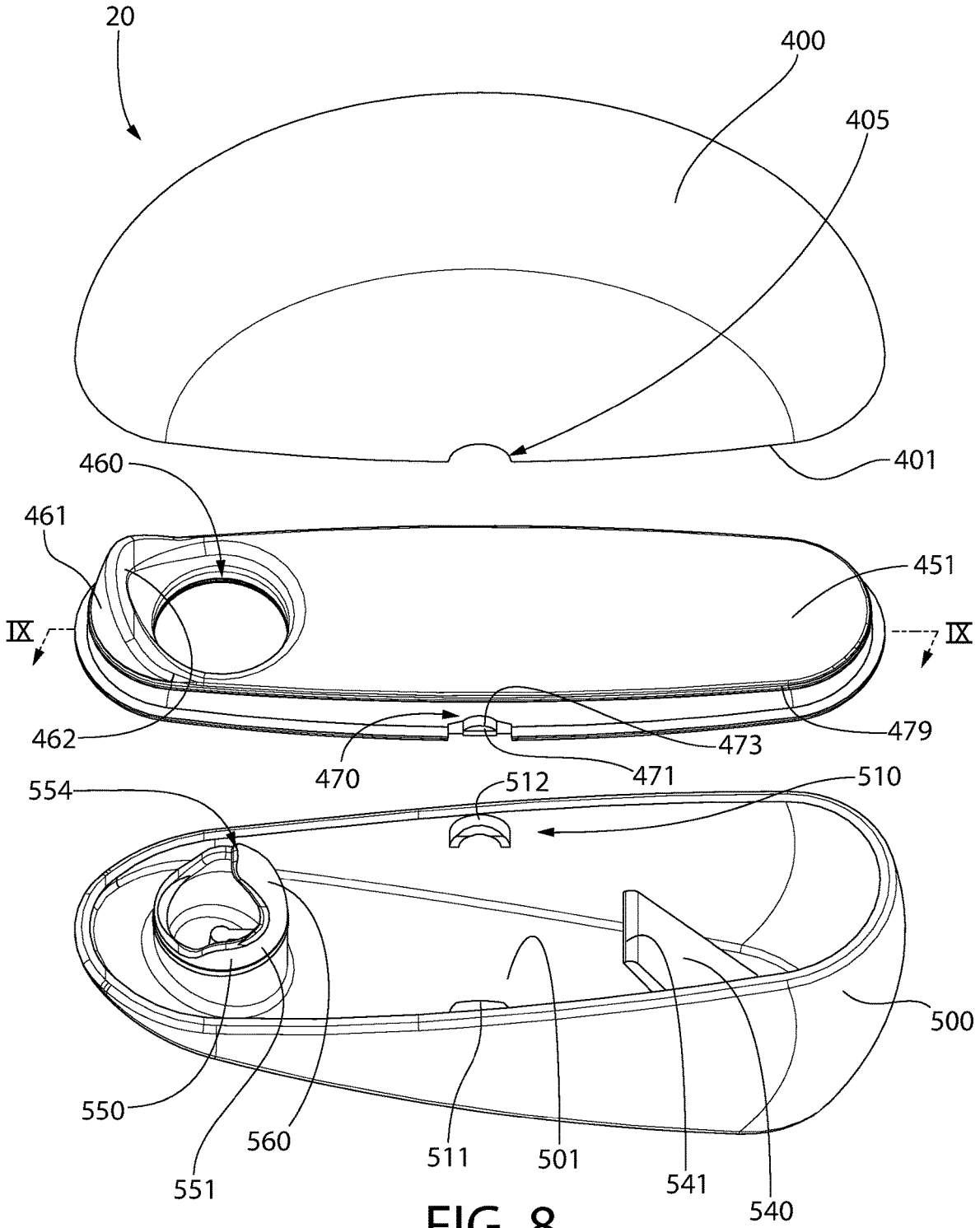
FIG. 8 is an exploded view of the dispenser of FIG. 7.
Figure 9:
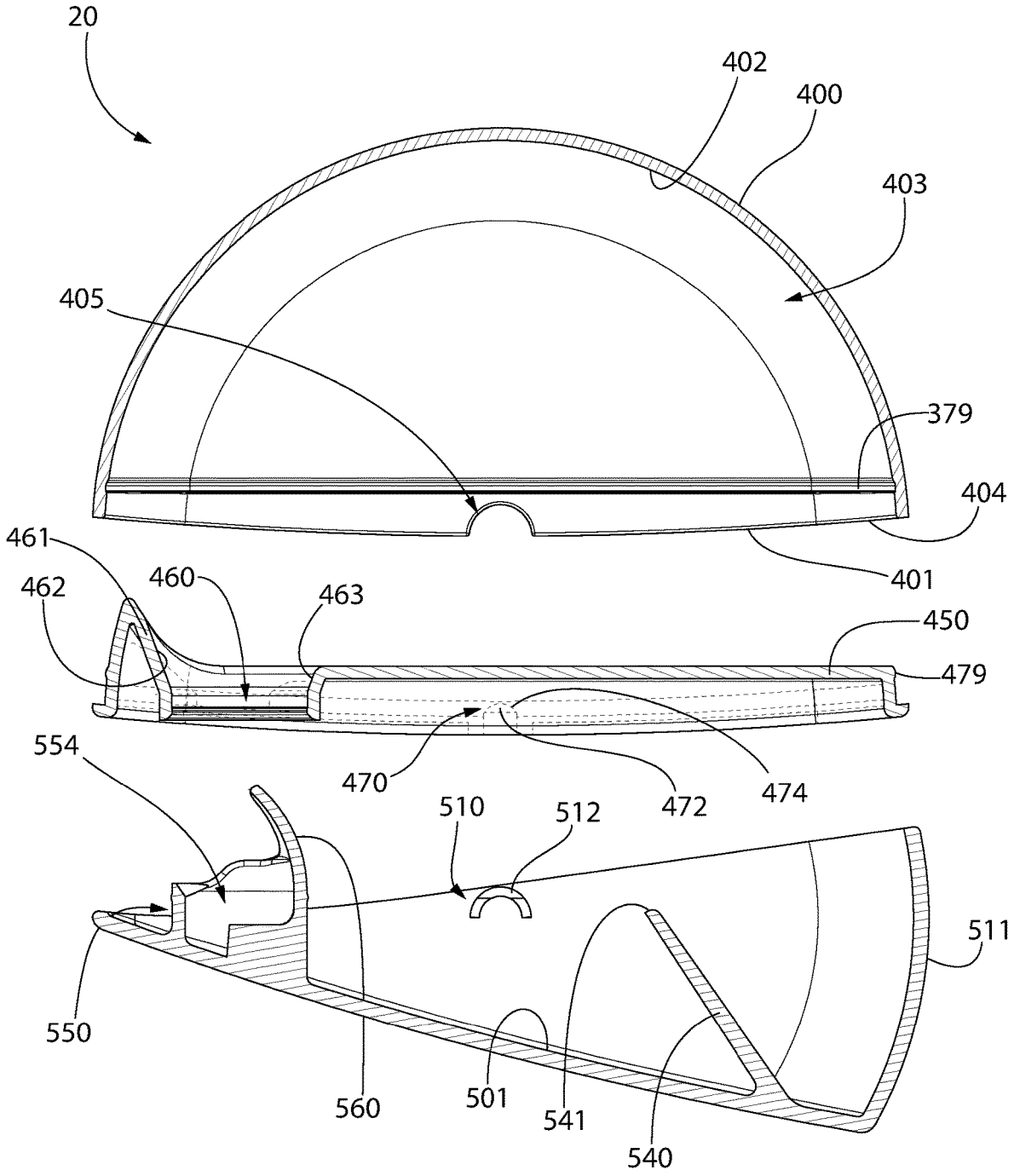
FIG. 9 is a cross-sectional view taken along line IX-IX of FIG. 8.

Next, referring to FIGS. 6D and 6E, the user can alter the second component 200 (or the dispenser as a whole) from the open state which is shown in FIG. 6D to the closed state which is shown in FIG. 6E. This may be achieved in various different ways depending on the structure and operation of the dispenser 10. For example, in the exemplified embodiment which uses the spring 140, upon the user releasing his/her hold on the second component 200, the spring 140 will exert an outward force, which will automatically cause the second component 200 to alter from the open state to the closed state. In other embodiments, a combination of the spring 140 and user interaction with or force applied onto the second component 200 is required to alter the second component 200 from the open state to the closed state. In still other embodiments, the spring 140 may be omitted and it is solely manual force applied by the user that will alter the second component 200 from the open state to the closed state.

As the second component 200 is altered from the second state to the first state, the blocker arm 260 pushes the second one of the consumable products 302 back into the internal cavity 103 of the first component 100 while continuing to prevent the second one of the consumable products 302 from being dispensed through the dispensing aperture 160. Moreover, once the second component 200 is in the closed state (or possibly at some intervening time during the altering of the second component 200 from the open state to the closed state), the second one of the consumable products 302 may pass into the holding cavity 254 of the cup-shaped member 250. The dispenser 10 is now primed for dispensing of the second one of the consumable products 302 by altering the second component 200 back into the open state.

Referring to FIGS. 7-10C, a second embodiment of a dispenser 20 is illustrated in accordance with an embodiment of the present invention. The dispenser 20 generally comprises a first component 400, a second component 500, and a cover member 450 as with the dispenser 10. Many features of the dispenser 20 are similar to features of the dispenser 10 described above, and such features will not be described herein below in the interest of brevity, it being understood that the description provided above is applicable. It should also be appreciated that operation of the dispenser 20 is essentially the same as the operation of the dispenser 10 described above, and thus a full and complete discussion of the operation of the dispenser 20 will not be provided below, it being appreciated that the description above related to the operation of the dispenser 10 is applicable. The focus of the description of the dispenser 20 will be on the features of the dispenser 20 which differ from the dispenser 10.

Figure 10A:
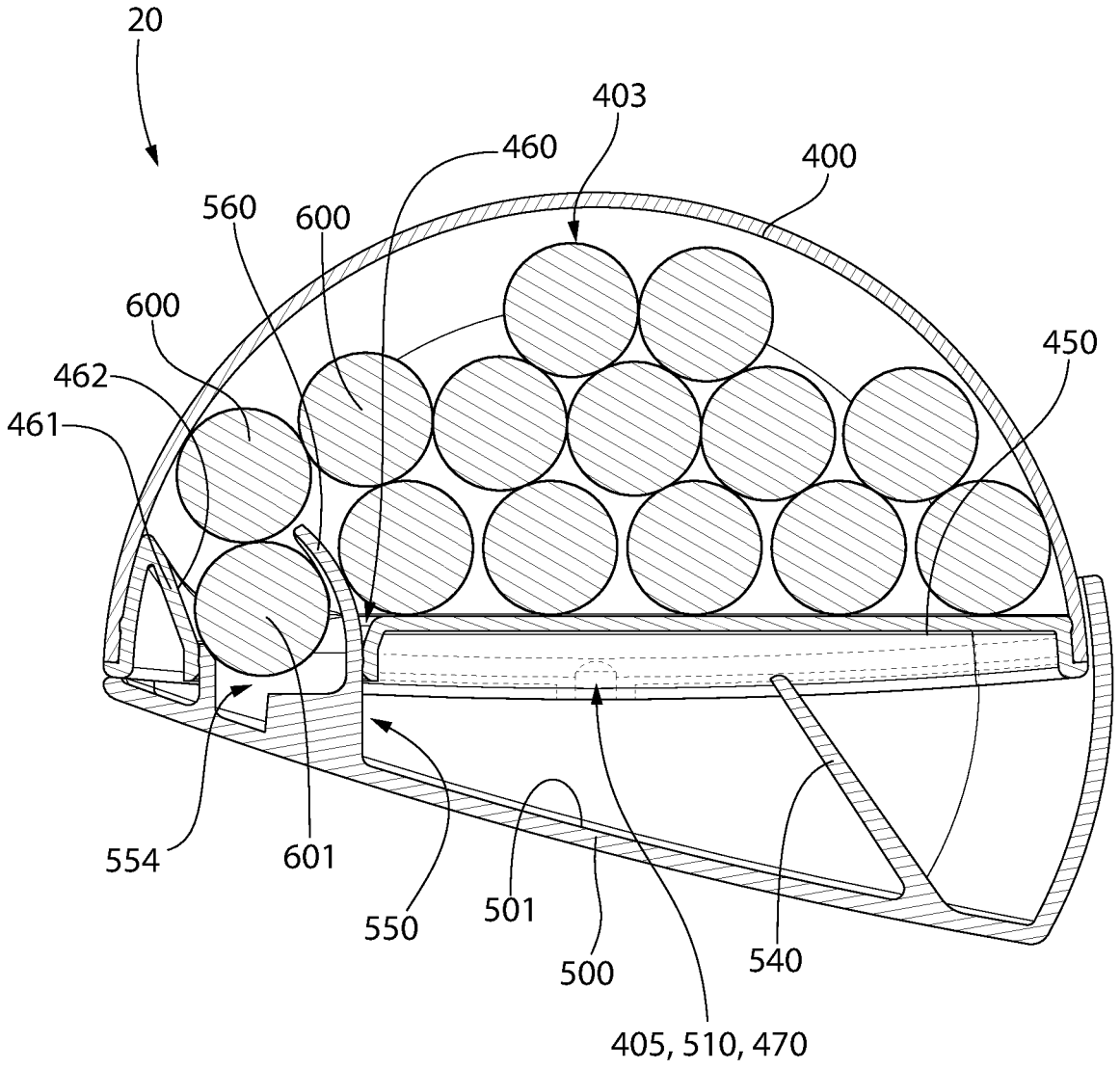
FIG. 10 is a cross-sectional view taken along line X-X of FIG. 7.
Figure 10B:
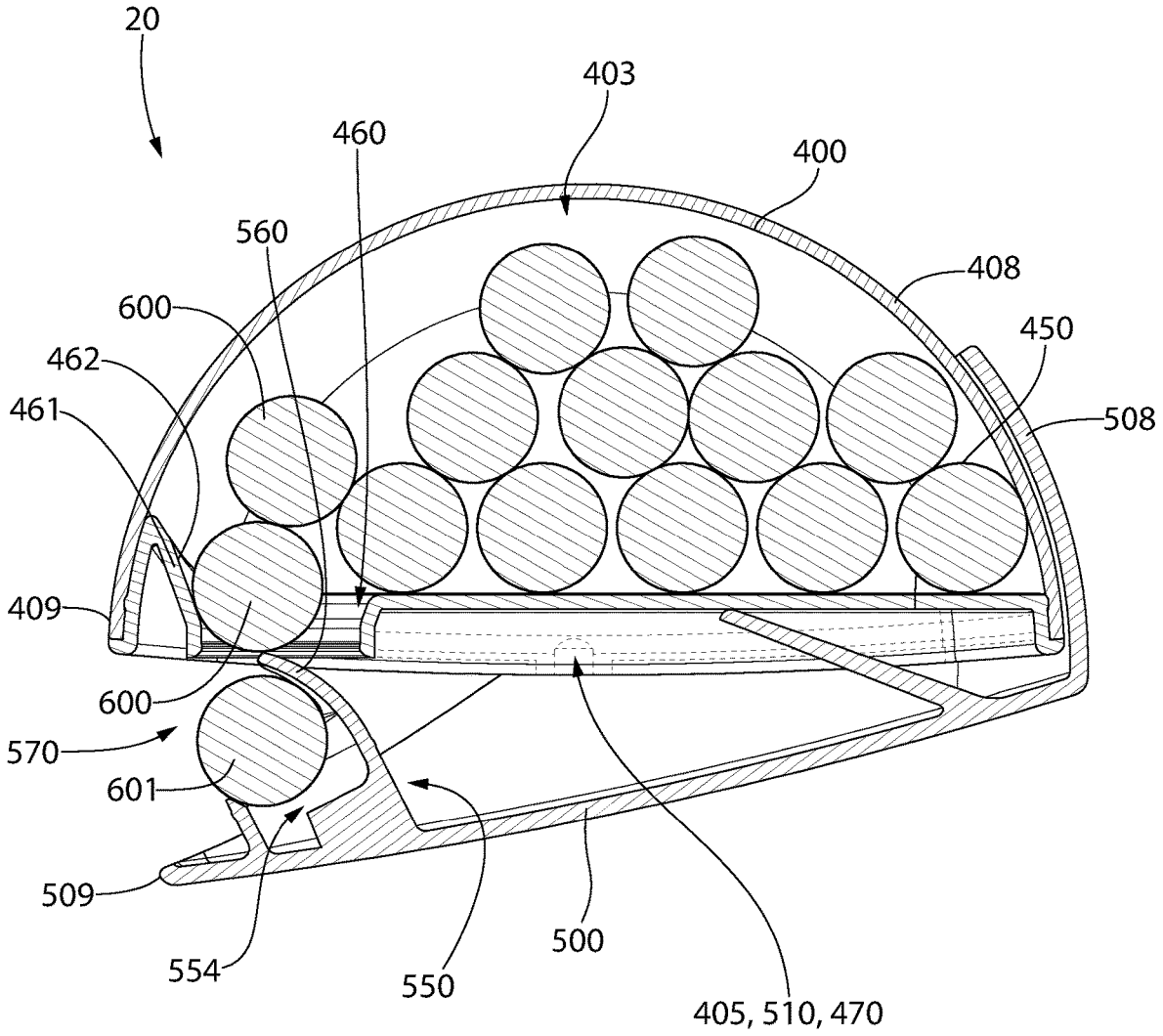

The first component 400 of the dispenser 20 is quite similar to the first component 100 of the dispenser 10 described above, with the main difference being the configuration of the pivot feature. That is, the first component 400 comprises a first pivot feature 405 which comprises first and second U-shaped notches formed into a bottom edge 401 of the first component 400. This is in contrast to the first pivot feature 105 of the first component 100 which was formed by the first and second arcuate protrusions 106, 107. The first component 400 comprises a storage cavity 403 which is defined by an inner surface 402 of the first component 400. The storage cavity 403 has an open end 404. Furthermore, the storage cavity 403 is configured to store a plurality of consumable products 1300 as illustrated in FIGS. 10A and 10B. In the exemplified embodiment, the open end 404 is located at the bottom edge 401 of the first component. The first component 400 is a half oblate sphere shape.

Figure 10C:
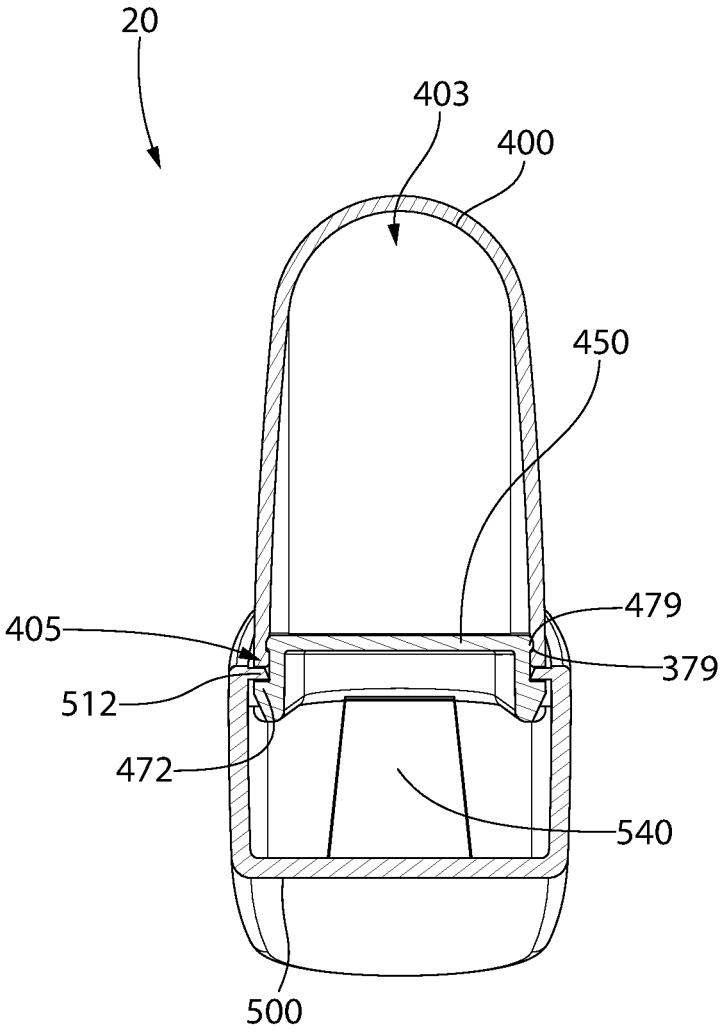

The cover member 450 is coupled to the first component 400 and covers the open end 404 of the first component 400. As with the prior embodiment, the cover member 450 could be formed integrally with the first component 100 or the second component 200 in other embodiments. With reference to FIG. 10C, in the exemplified embodiment the cover member 450 is connected to the first component 300 via a snap-fit connection. In particular, the cover member 450 comprises a protuberance 479 that nests within a recess 379 in the inner surface of the first component 300. In other embodiments, the first component 300 may comprise a protuberance that nests within a recess in the cover member 450. In either case, the cover member 450 may be connected to the first component 300 via a snap-fit engagement.

The cover member 450 comprises a dispensing aperture 460 that provides a passageway from the storage cavity 403 of the first component 400 to a location external to the storage cavity 403. However, in this embodiment there is a guide wall 461 extending along a portion of the periphery of the dispensing aperture 460. The guide wall 461 is an upstanding wall which extends upwardly from the upper surface 451 of the cover member 450. In particular, the guide wall 461 is located along a portion of the dispensing aperture 461 that is closest to a dispensing end of the dispenser 20 when assembled. The guide wall 461 comprises an angled surface 462 that is oriented at an oblique angle relative to an axis of the dispensing aperture 460. The guide wall 461 serves to feed the consumable products towards and into the dispensing aperture 460 to facilitate a loading of one of the consumable products onto a cup-shaped member or holding member of the second component 500, described below. The dispensing aperture 460 may comprise a funnel portion 463, which is formed by having an upper portion of the wall which surrounds the dispensing aperture 460 be angled outwardly away from a center of the dispensing aperture 460. This further serves to guide the consumable products into and through the dispensing aperture 460.

The cover member 450 comprises a third pivot feature 470, which comprises first and second protrusions 471, 472 (one illustrated in FIG. 8 and the other illustrated in FIG. 9) located on opposite sides thereof. Each of the first and second protrusions 471, 472 has a convex upper surface 473, 474.

The second component 500 comprises a second pivot feature 510 comprising a first arcuate protrusion 511 and a second arcuate protrusion 512. When the dispenser 20 is assembled, the first arcuate protrusion 511 nests between the first notch 405 of the first component 400 and the first protrusion 471 of the cover member 450 and the second arcuate protrusion 512 nests between the second notch 405 of the first component 400 and the second protrusion 472 of the cover member 450. The relationship between the first notch 405, and the protrusions 472, 512 is depicted in FIG. 10C. This enables the pivoting/rotational movement of the second dispenser 500 between the open and closed states to be the same as that which was described above for the dispenser 10.

The second component 500 also comprises a cup-shaped member (or holding member) 550 which is similar to the cup-shaped element 250 of the second component 200 of the dispenser 10. The cup-shaped member 550 comprises an annular wall 551 that defines a holding cavity 554 that is configured to hold one of the consumable products for dispensing thereof. The annular wall 551 may be partially annular in other embodiments or may comprise multiple walls that are spaced apart by gaps to form the overall annular shape. The second component 500 also comprises a blocking arm 560 that extends from a distal end of the annular wall 551 of the cup-shaped member 550 along a portion thereof. The blocking arm 560 extends upwardly away from the cup-shaped member 550 and inwardly towards an axis of the cup-shaped member 550. The blocking arm 560 is arcuate in its extension, but could be linear in other embodiments. The blocking arm 560 extends in a direction generally towards a front, dispensing end of the dispenser 20. The blocking arm 560 and the guide wall 461 collectively from a tunnel or chute to guide the consumable products into and through the dispensing opening 460 when the dispenser 20 is in the closed state.

The second component 500 comprises a floor 501, and the cup-shaped member 550 protrudes upwardly from the floor 501. Furthermore, in this embodiment the second component 500 comprises a spring element 540 that is formed integrally with the second component 500 and which extends upwardly from the floor 501. Thus, the spring element 540 is formed from plastic just like the remainder of the second component 500 rather than the spring 540 being a separate structure formed from metal or the like. The spring element 540 extends from the floor 501 to a distal end 541 at an oblique angle relative to the floor 501. Moreover, the spring element 540 extends along an axis that is oblique to the cover member 450 when the dispenser 20 is assembled. While the distal end 541 is spaced from the cover member 450 in the closed state in the exemplified embodiment (see FIG. 10A), in other embodiments the distal end 541 could be in contact with the cover member 450 in the closed state.

As noted above, the dispenser 20 operates in the same manner as the dispenser 10, which will be described briefly with reference to FIGS. 10A and 10B. It is noted that additional description of the operation is provided above for the dispenser 10 and is entirely applicable hereto because the dispensing function is identical between the dispenser 10 and the dispenser 20. Prior to use (and potentially prior to assembly), the dispenser 20 is filled with the consumable products 600. When the second component 500 is in the closed state, the cup-shaped member 550 nests within the dispensing opening 460 of the cover member 450 and the blocker arm 560 protrudes into the storage cavity 403 of the first component 400. When the second component 500 is in the closed state, the dispenser 20 may be shaken or tilted until one of the consumable products 601 is loaded into the holding cavity 554 of the cup-shaped member 550.

Next, the second component 500 is altered from the closed state (FIG. 10A) to the open state (FIG. 10B) by pivoting/rotating the second component 500 relative to the first component 400. This is achieved by applying a force onto a rear portion of a bottom surface of the second component 500 in a direction towards the first component 400. As the second component 500 pivots relative to the first component 400, a rear portion 508 of the sidewall of second component 500 wraps around a rear portion 408 of the sidewall of the first component 400, as depicted in a comparison of FIG. 10B with FIG. 10A.

Once the second component 500 is altered into the open state, the consumable product in the holding cavity 554 can be removed by a user for use/consumption. In particular, altering the second component 500 into the open state causes a front portion 509 of the second component 500 to pivot away from a front portion 409 of the first component 400 which creates an opening 570 in the dispenser 20. When the second component 500 is in the open state, the one of the consumable products 601 remains held by the cup-shaped member 550 and is not immediately dispensed from the dispenser 20. This prevents the consumable products 600 from being dispensed onto a floor or other dirty space and ensures that the user intentionally removes the consumable products 600 from the dispenser 20 when ready. When the second component 500 is in the open state, the one of the consumable products 601 and perhaps also a portion of the cup-shaped member 550 is exposed visually through the opening 570 so that it is accessible to a user. At this point, the user can insert his or her fingers through the opening 570 to grab the one of the consumable products 601 and remove it from the cup-shaped member 550 for use and/or consumption.

Furthermore, with the second component 500 in the open state, the blocker arm 560 prevents additional ones of the consumable products 600 located in the storage cavity 403 from being dispensed through the dispensing aperture 460. As seen in FIG. 10B, the blocker arm 560 blocks the bottom of the dispensing aperture 460 so that there is insufficient space for any of the consumable products 600 to fit between the blocker arm 560 and the wall which bounds and defines the dispensing aperture 460. Thus, the dispenser 20 allows for dispensing of a single one of the consumable products at a time for dosing, increased hygienic use, etc.

Figure 11:
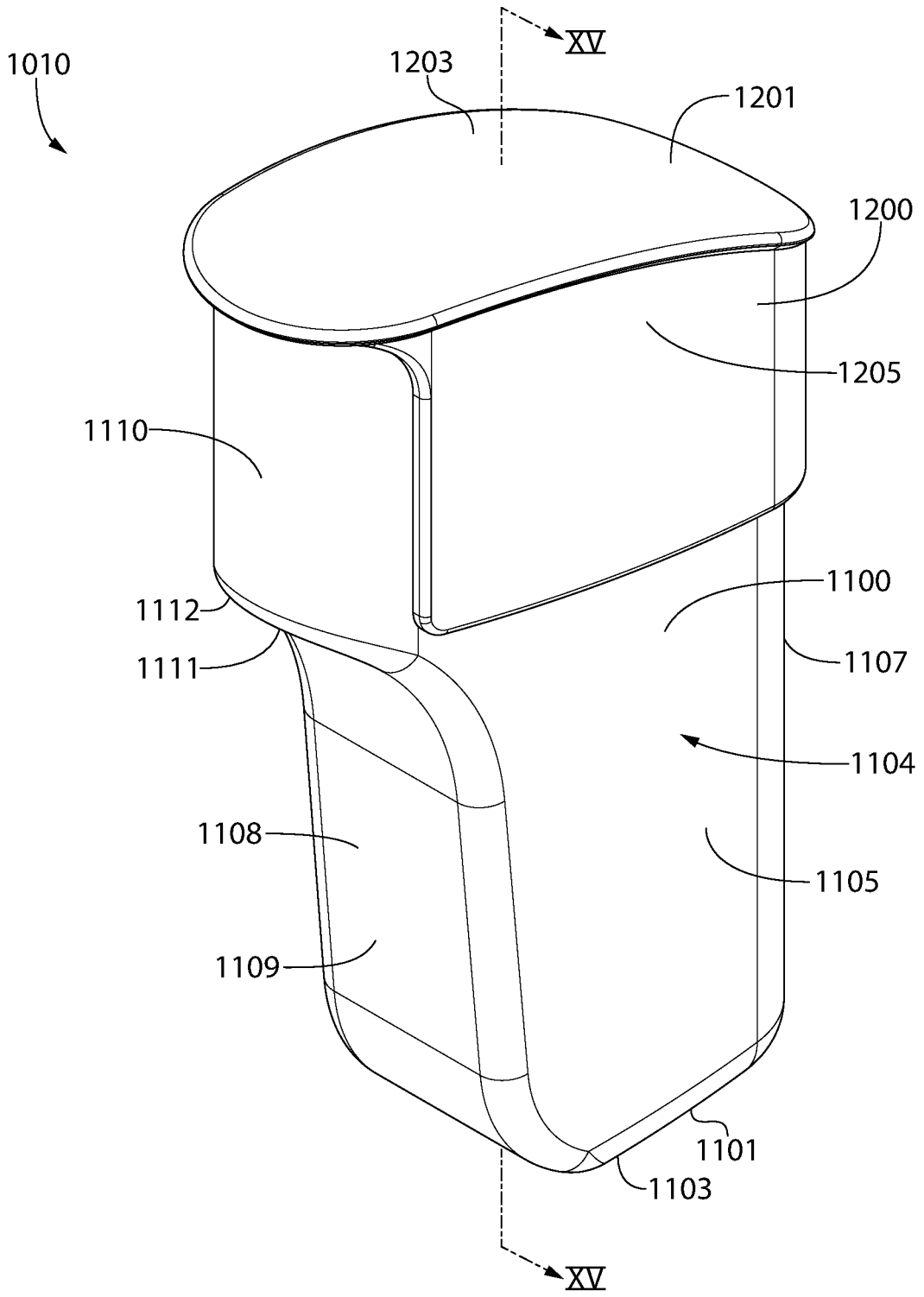
FIG. 11 is a front perspective view of a dispenser in accordance with another embodiment of the present invention, with a cover member of the dispenser in a closed state relative to a housing of the dispenser.
Figure 12:
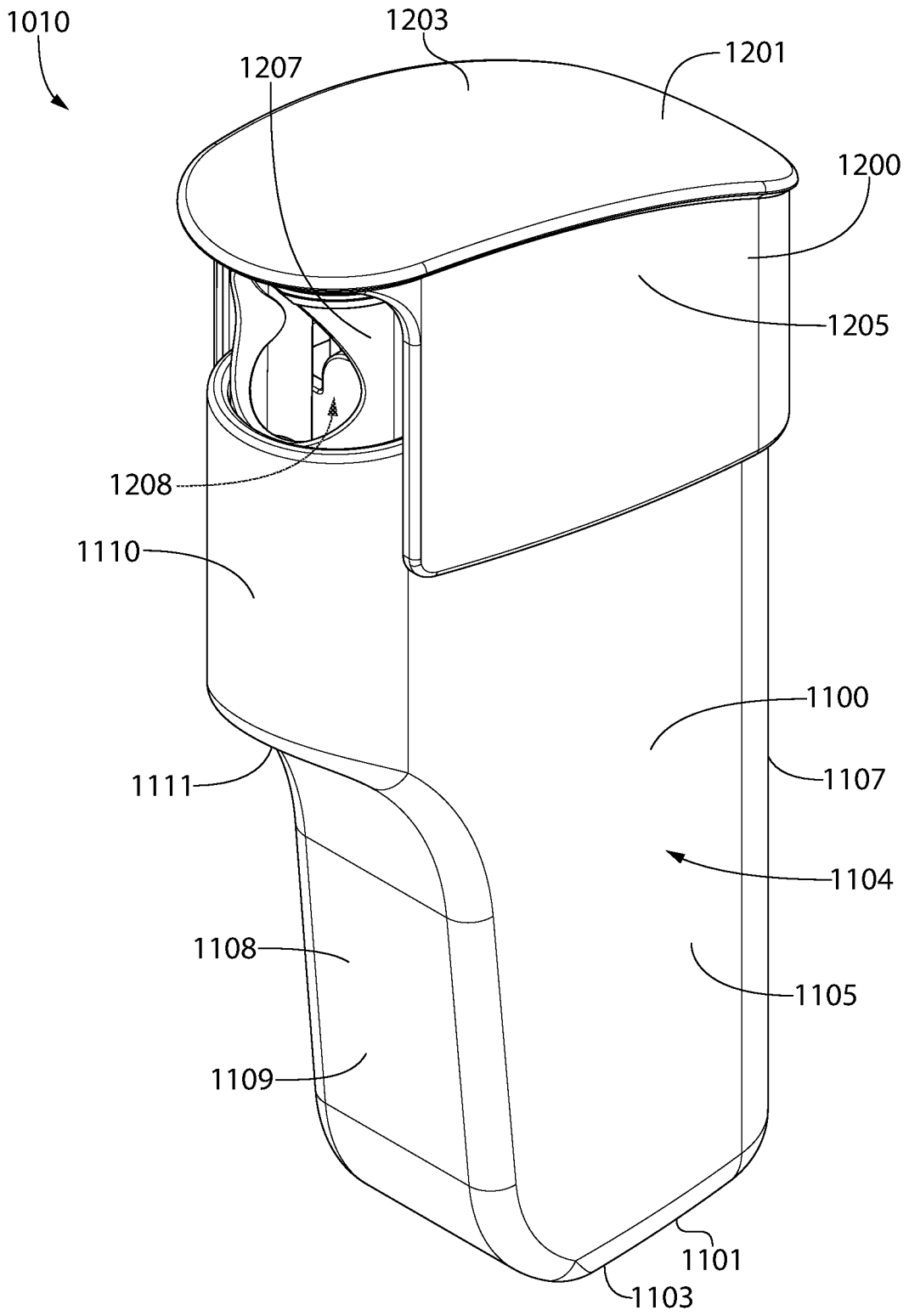
FIG. 12 is a front perspective view of the dispenser of FIG. 11 with the cover member in an open state.
Figure 13:
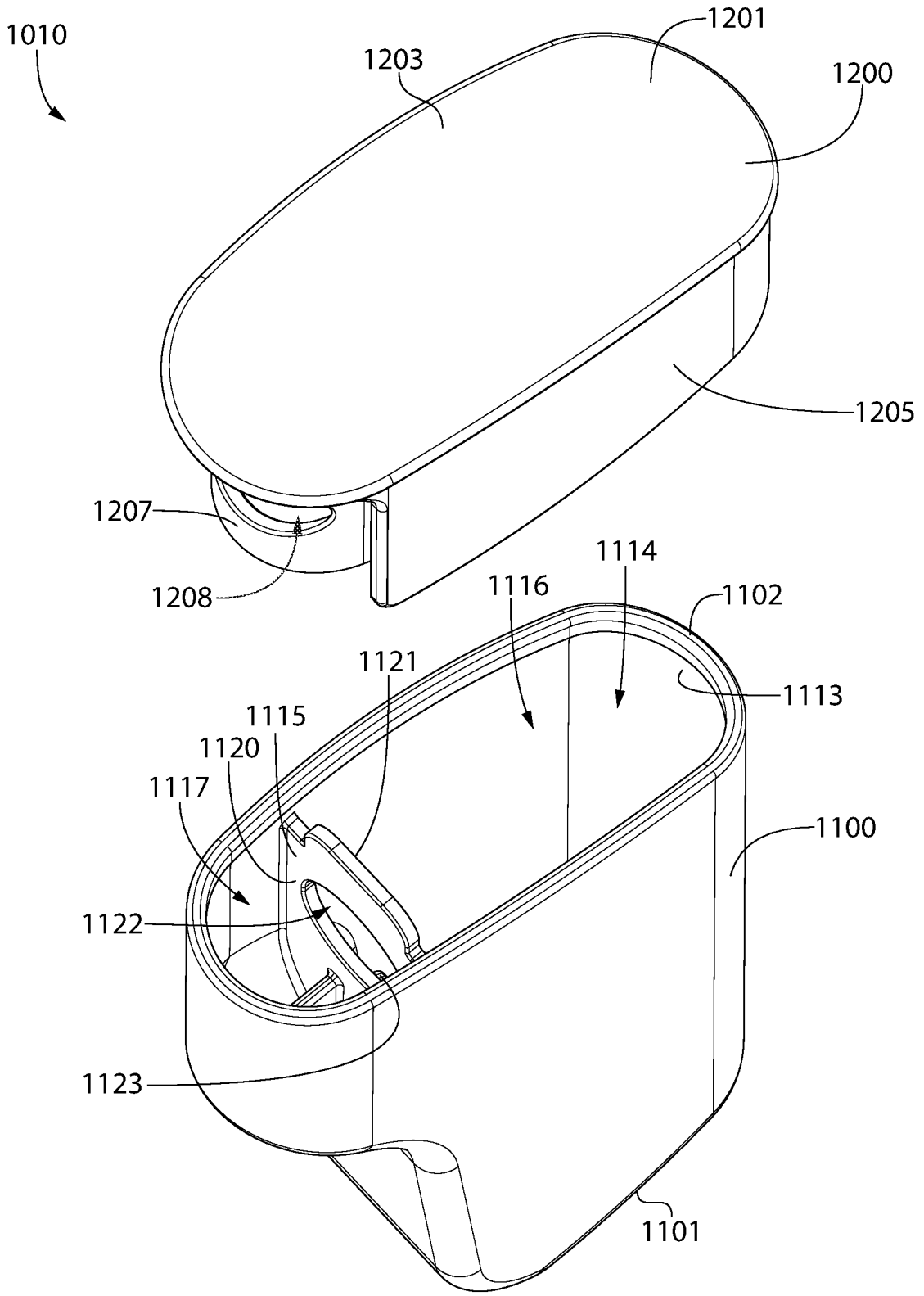
FIG. 13 is a top front perspective view of the dispenser of FIG. 11 with the cover member detached from the housing.
Figure 14:
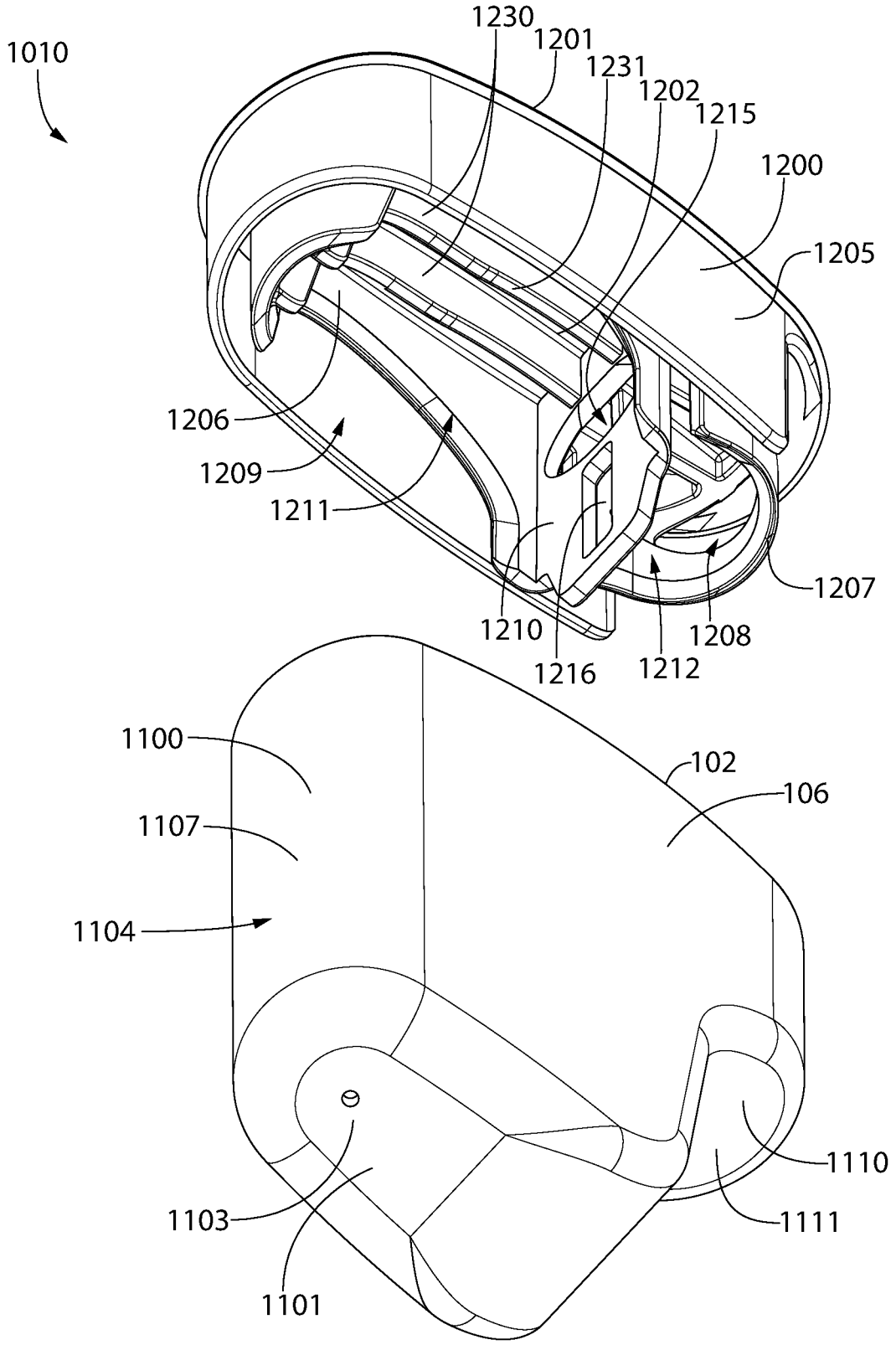
FIG. 14 is a bottom front perspective view of the dispenser of FIG. 11 with the cover member detached from the housing.

Referring first to FIGS. 11-15, a dispenser 1010 is illustrated in accordance with an embodiment of the present invention. The dispenser 1010 generally comprises a housing 1100 and a cover member 1200. The cover member 1200 is slidably coupled to the housing 1100 between a closed state (FIG. 11) and an open state (FIG. 12). The dispenser 1010 is intended to contain a plurality of consumable products, as shown in FIG. 16A. Additional details of the consumable products will be provided below. As will be better understood from the detailed description that follows, when the cover member 1200 is in the open state, only those of the consumable products that are located within a specialized compartment will be dispensed, with some internal structures preventing dispensing of the remaining ones of the consumable products. This allows for appropriate dosed dispensing of the consumable products without any additional effort required by the user.

The housing 1100 of the dispenser 1010 extends from a bottom end 1101 to a top end 1102 along a longitudinal axis B-B. The housing 1100 comprises a bottom wall 1103 and a sidewall 1104 extending from the bottom wall 1103 to the top end 1102. The sidewall 1104 comprises a front wall portion 1105, a rear wall portion 1106, a first lateral wall portion 1107, and a second lateral wall portion 1108. The front wall portion 1105, the rear wall portion 1106, and the first lateral wall portion 1107 are all oriented generally vertically and free of any shoulders or other protruding features. Of course, in other embodiments there could be protrusions or the like on any of the wall portions for purposes of enhancing user grip and rendering the dispenser 1100 easier to use. The second lateral wall portion 1108 comprises a first vertical portion 1109 that is connected to the bottom wall 1101, a second vertical wall portion 1110 that extends to the top end 1102, and a concave portion 1111 that extends between the first and second vertical wall portions 1109, 1110. The concave portion 1111 extends from the first vertical wall portion 1109 in a direction away from the longitudinal axis B-B, thereby forming a downwardly facing shoulder 1112.

The housing 1100 comprises an inner surface 1113 that defines an internal cavity 1114 having an open top end at the top end 1102 of the housing 1100. That is, the top end 1102 of the housing 1100 surrounds an opening into the internal cavity 1114. The housing 1100 comprises a divider wall 1115 that divides the internal cavity 1114 into a main compartment 1116 and a dispensing compartment 1117. An interior surface of the bottom wall 1103 of the housing 1100 forms a floor 1118 of the main compartment 1116 of the internal cavity 1114 of the housing 1100. An interior surface of the concave portion 1111 of the second lateral wall portion 1108 of the sidewall 1104 of the housing 1100 forms a floor 1119 of the dispensing compartment 1117 of the internal cavity 1114 of the housing 1100. Thus, in the exemplified embodiment the floor 1119 of the dispensing compartment 1117 is convex, although this is not required in all embodiments. Furthermore, in the exemplified embodiment the floor 1119 of the dispensing compartment 1117 is axially offset from the floor 1118 of the main compartment 1116, although the structure of the dispenser 1010 may be modified and this is not necessarily required in all embodiments. The shape and structure of the dispenser 1010 is intended to impart enhanced ergonomics and comfortable handling and use, but modifications are possible without affecting the function as described herein.

The main compartment 1116 is bounded by the bottom wall 1103, the front wall portion 1105, the rear wall portion 1106, the first lateral wall portion 1107, the first vertical portion 1109 of the second lateral wall portion 1108, and the divider wall 1115. The dispensing compartment 1117 is bounded by the concave portion 1111 of the second lateral wall portion 1108, the second vertical portion 1110 of the second lateral wall portion 1108, portions of the front and rear walls 1105, 1106, and the divider wall 1115.

The divider wall 1115 comprises a front surface 1120 that faces the dispensing compartment 1117 and a rear surface 1121 that faces the main compartment 1116. The divider wall 1115 comprises an opening 1122 that extends from the front surface 1120 to the rear surface 1121. The opening 1122 in the divider wall 1115 forms a passageway between the main compartment 1116 and the dispensing compartment 1117. Moreover, the opening 1122 is the only passageway between the main compartment 1116 and the dispensing compartment 1117. In the exemplified embodiment, and as discussed in greater detail below, the opening 1122 in the divider wall 1115 has a cross-sectional shape and area that is configured to allow only one of the consumable products to fit therethrough at a time. Thus, the opening 1122 does not have a specific cross-sectional shape/area, but rather the cross-sectional size and shape of the opening 1122 can be dictated based on the size and shape of the consumable products to ensure that only one of the consumable products can fit through the opening 1122 in the divider wall 1115 at a time.

Similarly, the dispensing compartment 1117 is configured to hold or otherwise contain a single one of the consumable products at a time. That is, the size or volume of the dispensing compartment 1117 is such that only one of the consumable products is able to fit within the dispensing compartment 1117 at a time. In some embodiments, it is the combination of the size/shape of the opening 1122 in the divider wall 1115 and the size/shape of the dispensing compartment 1117 that ensures that only one of the consumable products can be disposed within the dispensing compartment 1117 at a time. This will be discussed in greater detail below with reference to FIG. 16B.

In the exemplified embodiment, the divider wall 1115 comprises a coupling tab 1123 protruding from the rear surface 1121 of the divider wall 1115. The coupling tab 1123 interacts with a coupling feature of the cover member 1200 to maintain the coupling between the cover member 1200 and the housing 1100 when the cover member 1200 is in the closed state as shown in FIG. 11 and the open state as shown in FIG. 12. While in the exemplified embodiment the housing 1100 includes the coupling tab 1123 and the cover member 1200 includes a mating slot (described below), in other embodiments the housing 1100 may include a slot which mates with a tab of the cover member 1200. Moreover, other mechanisms for ensuring that the cover member 1200 remains attached to the housing 1100 in both the open and closed states may be used. For example, the housing 1100 may include a ridge along the top end 1102 thereof that engages a lip protruding inwardly from a sidewall of the cover member 1200 such that engagement between the lip and the ridge prevents the cover member 1200 from being readily detached from the housing 1100.

Still referring to FIGS. 11-15, the cover member 1200 will be described. The cover member 1200 comprises a top wall 1201 that covers the open top end of the internal cavity 1114 of the housing 1100 when the cover member 1200 is coupled to the housing 1100. The top wall 1201 has an lower surface 1202 and an upper surface 1203, with the lower surface 1202 facing the internal cavity 1114 of the housing 1100 when the cover member 1200 is coupled to the housing 1100 and the outer surface 1203 forming an exposed top surface of the dispenser 1010.

The cover member 1200 comprises an outer sidewall 1205 that extends from the lower surface 1202 of the top wall 1201. The cover member 1200 also comprises an inner sidewall 1206 that extends from the lower surface 1202 of the top wall 1201. In the exemplified embodiment, the inner and outer sidewalls 1205, 1206 are spaced apart so that when the cover member 1200 is coupled to the housing 1100, an upper portion of the sidewall 1104 of the housing 1100 nests within the space between the inner and outer sidewalls 1205, 1206. It may be possible to omit one of the inner and outer sidewalls 1205, 1206 in some embodiments without affecting the attachment between the cover member 1200 and the housing 1100. In the exemplified embodiment, the outer and inner sidewalls 1205, 1206 of the cover member 1200 are collectively referred to as the sidewall of the cover member 1200.

Figure 15:
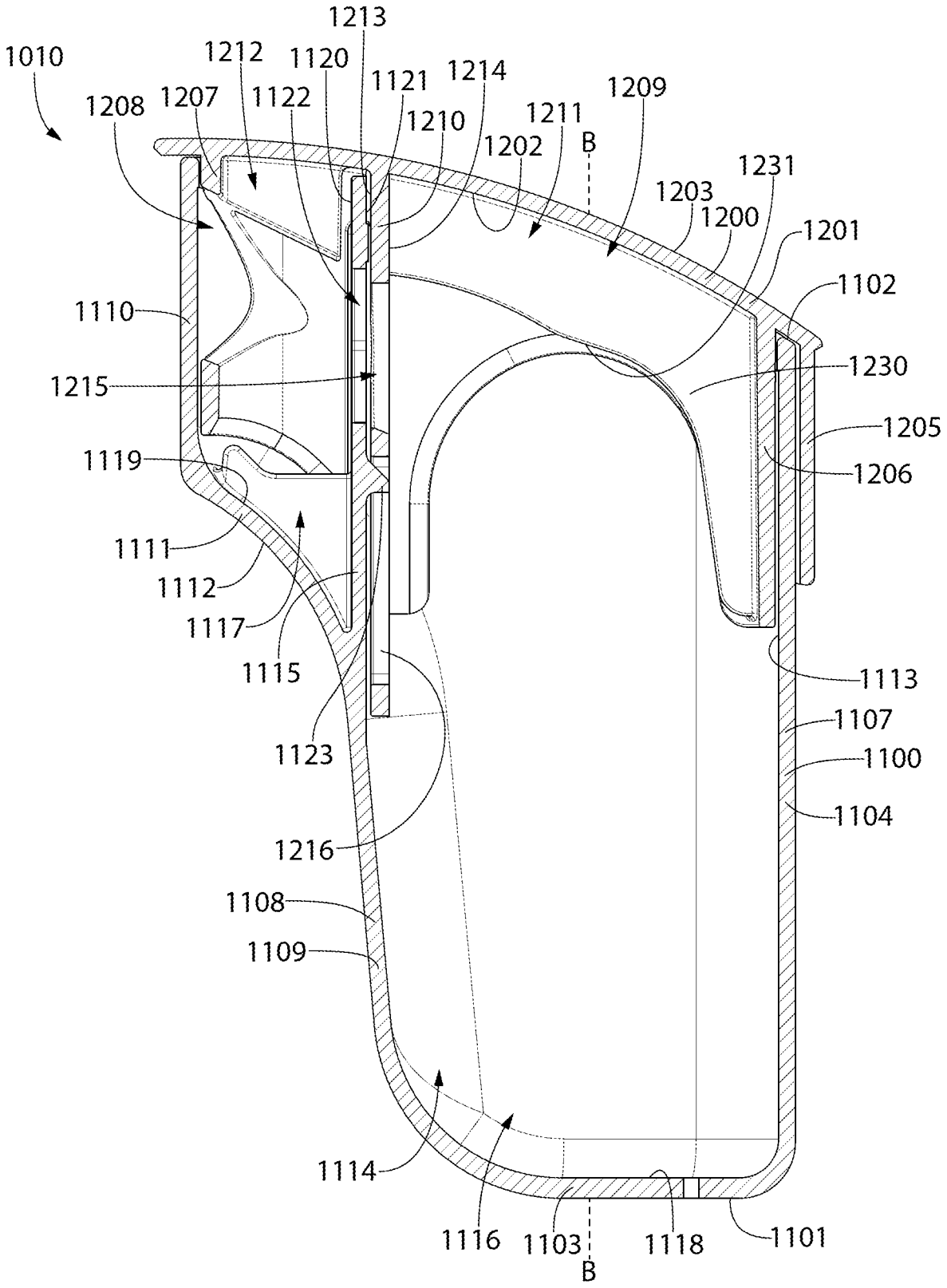
FIG. 15 is a cross-sectional view taken through line XV-XV of FIG. 11.
Figure 16A:
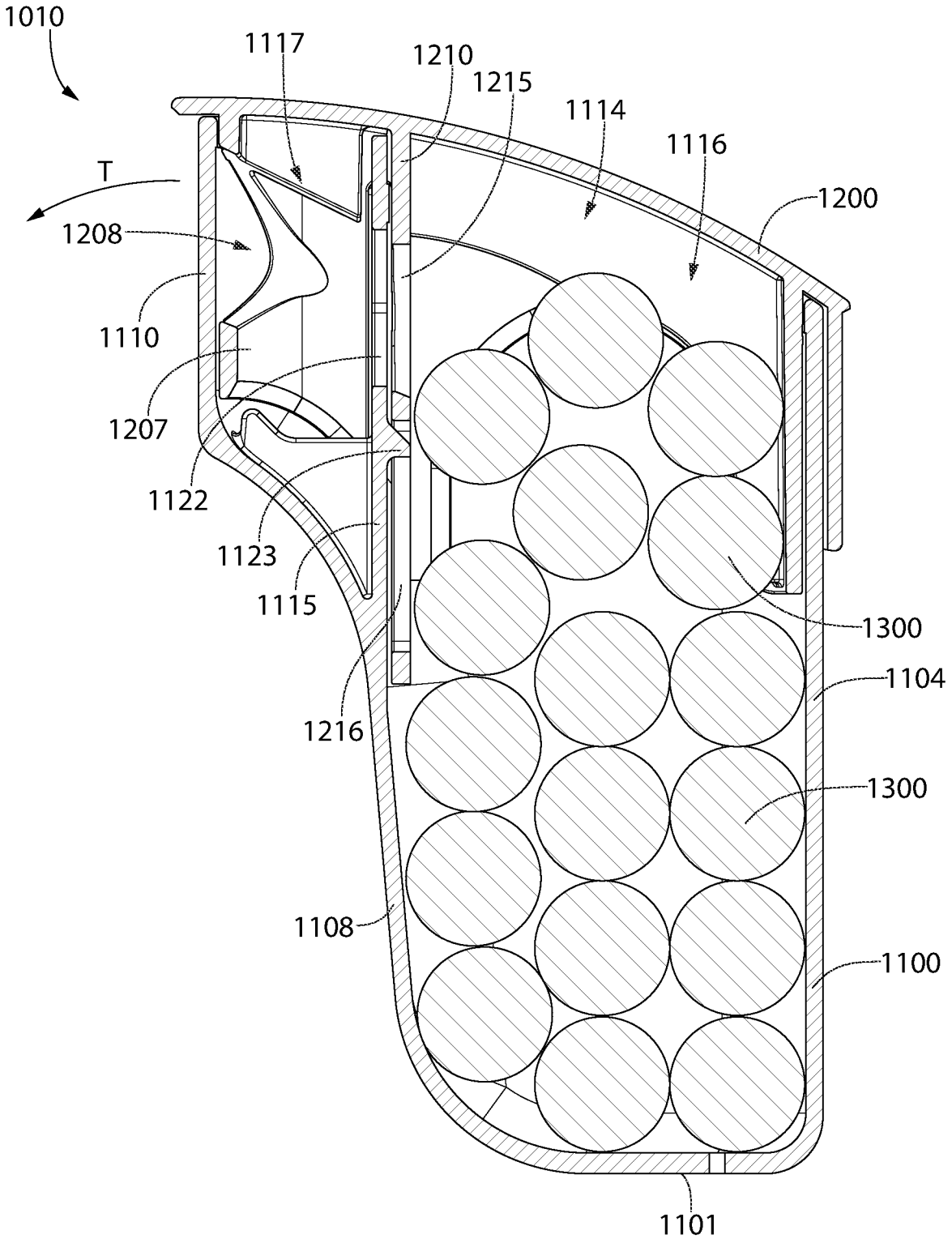
FIG. 16A is the cross-sectional view of FIG. 15 with the dispenser filled with consumable products, all of which are located within a main compartment of an internal cavity of the dispenser.

The sidewall of the cover member 1200 comprises a dispensing portion 1207 that is located within the dispensing compartment 1117 of the housing 1100 when the cover member 1200 is coupled to the housing 1100, as best seen in FIG. 15. The dispensing portion 1207 of the sidewall is formed as part of the inner sidewall 1206 in the exemplified embodiment. The dispensing portion 1207 of the sidewall comprises a dispensing opening 1208 that permits passage of the one or more consumable products from the dispensing compartment 1117 to an external environment when the cover member 1200 is altered from the closed state to the open state, as described in greater detail below with reference to FIGS. 16C and 16D.

The top wall 1201 and the sidewall 1205, 1206 collectively define a cover cavity 1209. Thus, the lower surface 1202 of the top wall 1201 forms a floor of the cover cavity 1209 and the sidewall 1205, 1206 forms an outer boundary of the cover cavity 1209. Moreover, the cover member 1200 comprises a stopper wall 1210 extending from the lower surface 1202 of the top wall 1201 into and through the cover cavity 1209. The stopper wall 1210 divides the cover cavity 1209 into a first portion 1211 and a second portion 1212, with the second portion 1212 being located between the stopper wall 1210 and the dispensing portion 1207 of the sidewall 1205, 1206. When the cover member 1200 is coupled to the housing 1100, the first portion 1211 of the cover cavity 1209 is aligned with the main compartment 1116 of the internal cavity 1114 of the housing 1100 and the second portion 1212 of the cover cavity 1209 is aligned with the dispensing compartment 1117 of the internal cavity 1114 of the housing 1100.

The stopper wall 1210 comprises a front surface 1213 that faces the second portion 1212 of the cover cavity 1209 and a rear surface 1214 that faces the first portion 1211 of the cover cavity 1209. Furthermore, the stopper wall 1210 comprises a pass-through opening 1215 that extends from the front surface 1213 to the rear surface 1214. As will be explained below with reference to FIGS. 16A-16E, the stopper wall 1210 blocks the opening 1122 in the divider wall 1115 of the housing 1100 when the cover member 1200 is in the open state to prevent the consumable products from passing from the main compartment 1116 to the dispensing compartment 1117 when the cover member 1200 is in the open state. This ensures that only one of the consumable products is dispensed from the dispenser 1010 at a time (the consumable product that is already located in the dispensing compartment 1117 when the cover member 1200 is altered from the closed state to the open state). When the cover member 1200 is in the closed state, the pass-through opening 1215 in the stopper wall 1210 is aligned with the opening 1122 in the divider wall 1115 so that one of the consumable products can pass from the main compartment 1116 into the dispensing compartment 1117 when the cover member 1200 is in the closed state. FIG. 15 illustrates the dispenser 1010 with the cover member 1200 in the closed state, and as can be seen the pass-through opening 1215 is aligned with the opening 1122 in the divider wall 1115 so that it is possible for the consumable products to move between the main compartment 1116 and the dispensing compartment 1117.

The stopper wall 1210 additionally comprises a coupling slot 1216 which is elongated in the vertical direction. When the cover member 1200 is coupled to the housing 1100, the stopper wall 1210 is positioned adjacent to the rear surface 1121 of the divider wall 1115 of the housing 1100. In particular, the front surface 1213 of the stopper wall 1210 faces the rear surface 1121 of the divider wall 1115 of the housing 1100. When so positioned, the coupling tab 1123 protruding from the rear surface 1121 of the divider wall 1115 of the housing 1100 nests within the coupling slot 1216 formed through the stopper wall 1210. Thus, as the cover member 1200 slides relative to the housing 1100, the coupling tab 1123 slides relative to the coupling slot 1216 (or vice versa) with the coupling tab 1123 remaining located within the coupling slot 1216. This prevents the cover member 1200 from being readily detached from the housing 1100. As can be appreciated, when the cover member 1200 is in the fully open state, the coupling tab 1123 will abut against an interior surface of the stopper wall 1210 which surrounds the coupling slot 1216 to prevent further sliding of the cover member 200 in the open direction. Of course, with a significant amount of force a user may be able to pull the coupling tab 1123 out of the coupling slot 1216, but a user will be made aware that this is not intended when the coupling tab 1123 abuts the interior surface of the stopper wall 1210 as noted.

The pass-through opening 1215 in the stopper wall 1210 is elevated relative to the lower surface 1202 of the top wall 1201 of the cover member 1200. Thus, in order to ensure that the consumable products are aligned with the pass-through opening 1215 during a dispensing operation, the cover member 1200 comprises a plurality of ribs 1230 that protrude from the lower surface 1202 of the top wall 1201. The ribs 1230 terminate at a distal end 1231 that is aligned with or recessed slightly below the pass-through opening 1215 in the stopper wall 1210. Thus, the consumable products will be elevated by the ribs 1230 and fed through the pass-through opening 1215 in the stopper wall 1210 when a user is dispensing the consumable products from the dispenser 1010, as described in greater detail below with reference to FIGS. 16A-16E.

As best seen in FIG. 15, when the cover member 1200 is coupled to the housing 1100, the dispensing portion 1207 of the sidewall 1205, 1206 of the cover member 1200 is located within the dispensing compartment 1117 of the interior cavity 1114 of the housing 1100. Furthermore, the stopper wall 1210 is located within the main compartment 1116 of the interior cavity 1114 of the housing 1100. In an alternative embodiment, the stopper wall 1210 may also be located within the dispensing compartment 1117 of the interior cavity 1114 of the housing 1100. With the cover member 1100 in the closed state, the pass-through opening 1215 in the stopper wall 1215 is aligned with the opening 1122 of the divider wall 1115 to allow the consumable products to pass freely, one at a time, between the main compartment 1116 and the dispensing compartment 1117. Moreover, the dispensing opening 1208 in the dispensing portion 1207 of the sidewall 1205, 1206 of the cover member 1200 is blocked by the second vertical portion 1110 of the second lateral wall portion 1108 of the housing 1100. As such, the consumable products are prevented from exiting the interior cavity 1114 of the housing 1100 when the cover member 1200 is in the closed state. Furthermore, in the closed state, the cover member 1200 seals the package to keep the product safe and fresh and to prevent opening by mistake.

In one embodiment, when the cover member 1200 is closed, there is a plug seal feature which interfaces with the circumference of the housing 1100 to keep the cover member 200 closed tight when not in use, protecting the consumable product 1300 from any possible damage due to air, moisture, foreign objects, etc.). Such a seal may be needed to prevent the cover member 1200 from freely slide up and down along the housing 1100. In the exemplified embodiment, the inner sidewall 1206 is a continuous wall which goes all around the circumference of the housing 1100 to perform the sealing function. Moreover, the seal feature may provide a tactile and possibly audible cue that the package is closed (i.e., similar to when a product is snapped shut, a user feels the friction/force, and may hear a snap.

In some embodiments, the housing 1100 may be formed from plastic and may be transparent. This would allow a user to have the ability to visually inspect the contents of the dispenser 1010, including seeing how many of the consumable products remain located within the internal cavity 1114 of the dispenser 1010 for use. In some embodiments, the cover member 1200 may also be formed from plastic and may be transparent. In other embodiments, the cover member 1200 may be formed from a translucent or opaque material. Moreover, the housing 1100 may be translucent or opaque in some embodiments as well. Thus, variations in the degree of transparency of the various parts of the dispenser 1010 are possible within the scope of the invention described and claimed herein.

Referring now to FIGS. 16A-16E sequentially, the operation of the dispenser 1010 to dispense consumable products 1300 will be described. As mentioned previously, FIGS. 16A-16E illustrate the dispenser 1010 with the consumable products 1300 contained therein. The consumable products 1300 may take many different forms. The consumable products 1300 may be referred to as consumable beads in some embodiments. The consumable products 1300 may be tablets, capsules, dissolvable articles, or the like. While in the exemplified embodiment the consumable products 1300 are round or spherical in shape, the invention is not to be so limited and the consumable products 1300 may take on any desired shape, including without limitation cubes, pyramids, stars, randomized, or the like. The consumable products 1300 may all have the same shape, or various consumable products 1300 within the same dispenser 1010 may have different shapes.

In the exemplified embodiment, the consumable products 1300 comprise a dissolvable outer shell that surrounds an active agent. The dissolvable outer shell may be formed from polyvinyl alcohol or other dissolvable film materials. Moreover, the active agent may be a mouthwash or a toothpaste product when the consumable product 1300 is intended for oral care. Thus, the consumable products 1300 may be oral care products that are dispensed, one at a time, from the dispenser 1010 and then inserted into the user's oral cavity to provide some benefit (fresh breath, anti-bacterial, saliva stimulation, sensitivity treatment, or the like). Where the consumable products 1300 are toothpaste products, the consumable products 1300 may be dispensed and then placed onto a toothbrush for use. Moreover, while the consumable products 1300 are described herein as being used for oral care, the invention is not to be so limited and the consumable products 1300 may take on other forms, including being soap products (one-time use or multi-use), acne treatment products, skin moisturizer products, sanitizer, or the like. Moreover, the consumable product may include bath bombs and the like. In still other embodiments, the consumable products 1300 may be chewing gum, mints, or the like. As used herein, the term consumable refers to any product that gets used up and decreases in size over time, and does not specifically require that the product be ingested. Moreover, the term product is merely intended to mean a small mass of material used for imparting a benefit to its user (a medicinal product, a mouthwash product, a toothpaste product, a moisturizing product, an acne treatment product, a sanitizing product, etc.).

FIG. 16A illustrates the dispenser 1010 filled with the consumable products 1300. In FIG. 16A, the dispenser 1010 is in its upright orientation with the bottom end 1101 of the housing 1100 facing downwardly (e.g., towards the floor of a room or the ground of an exterior environment). In FIG. 16A, the cover member 1200 is in the closed state. As such, the dispensing opening 1208 is blocked by the second vertical portion 1110 of the second lateral wall portion 1108 of the sidewall 1104 of the housing 1100. In this position, the pass-through opening 1215 in the stopper wall 1210 of the cover member 1200 is in sufficient alignment with the opening 1122 of the divider wall 1115 of the housing 1100 such that the consumable products 1300 could fit, one-by-one, through the pass-through opening 1215 and the opening 1122 to move from the main compartment 1116 into the dispensing compartment 1117.

Figure 16B:
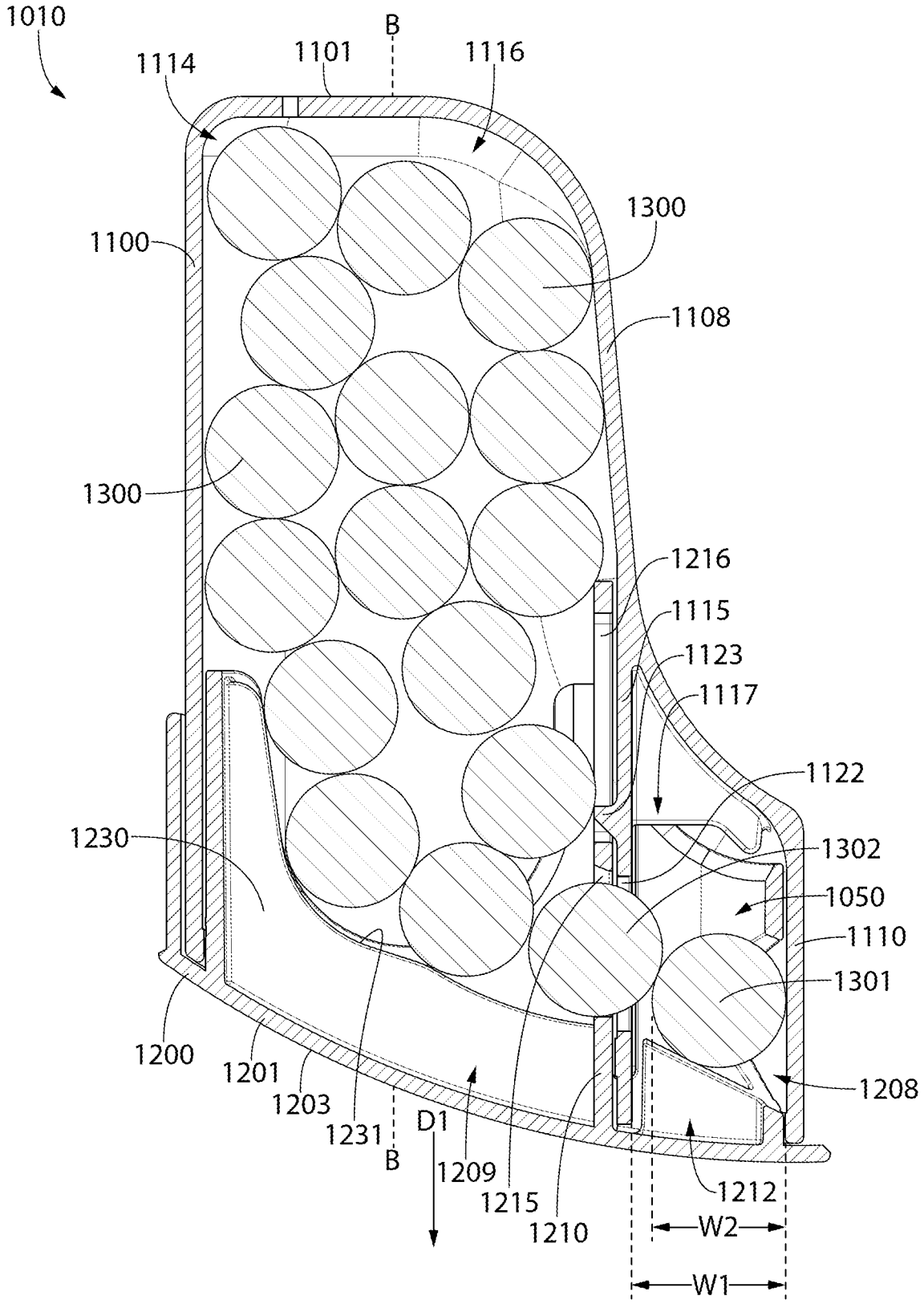
FIG. 16B is the cross-sectional view of FIG. 16A with the dispenser being rotated 180° so that one of the consumable products can move into a dispensing compartment of the internal cavity of the dispenser.

In order to dispense one of the consumable products 1300 from the dispenser 1010, it may be necessary to tilt the dispenser 1010 in the direction of the arrow T so that the dispensing aperture 1208 faces downwardly. Alternatively, the dispenser 1010 may be rotated so that it is oriented upside-down with the bottom wall 1101 facing upwardly. FIG. 16B illustrates the dispenser 1010 after it has been rotated upside-down. It should be appreciated that the dispenser 1010 need not be turned completely upside-down to perform its dispensing function, but rather a tilting of the dispenser 1010 may achieve the same results.

As seen in FIG. 16B, the dispenser 1010 has been rotated 180° so that the bottom wall 1101 faces upwardly and the upper surface 1203 of the top wall 1201 of the cover member 11200 faces downwardly. When the dispenser 1010 is tilted or rotated in this manner, one of the consumable products 1301 is fed through the pass-through opening 1215 of the stopper wall 1210 and the opening 1122 of the divider wall 1115. That is, the one of the consumable products 1301 moves from being located within the main compartment 1116 of the internal cavity 1114 to being located within the dispensing compartment 1117 of the internal cavity 1114. This is helped by the fact that the distal ends 1231 of the ribs 1230 are curved downwardly towards the pass-through opening 1215 of the stopper wall 1210 and the opening 1122 of the divider wall 1115. Thus, the consumable products 1301 ride along the curved distal ends 1231 of the ribs 1230 and are fed into and through the aforementioned openings 1215, 1122. This movement of the one of the consumable products 1301 may occur solely by gravity.

Moreover, it is possible for the one of the consumable products 1301 to pass through the openings 1215, 1122 because the openings 1215, 1122 are substantially aligned when the cover 1200 is in the closed state. Thus, the pass-through opening 1215 of the stopper wall 1210 is not significantly blocked by the divider wall 1115 and the opening 1122 of the divider wall 1115 is not significantly blocked by the stopper wall 1210.

While the internal cavity 1114 was previously described as being part of the housing 1100, in actuality the internal cavity 1114 is formed collectively by the housing 1100 and the cover member 1200. This distinction is important in terms of understanding the location of the consumable products 1300 within the dispenser 1010 during the dispensing process. In particular, as the cover member 1200 is translated away from the housing 1100 as discussed below with reference to FIG. 16B, the one of the consumable products 1301 remains located within the second portion 1212 of the cover cavity 1209. However, as described herein, the second portion 1212 of the cover cavity 1209 and the dispensing compartment 1117 of the internal cavity 1114 of the housing 1100 collectively form a dispensing compartment 1050 of the dispenser 10

The dispensing compartment 1050 of the dispenser 1010 is sized, shaped, and therefore configured to hold just a single one of the consumable products 1300 at a time. In the exemplified embodiment, this is accomplished by forming the dispensing compartment 1050 of the dispenser 1010 with a width W1 that is greater than a width or diameter of one of the consumable products 1300 but less than a width or diameter of two of the consumable products 1300. Specifically, whereas the dispensing compartment 1050 has a width W1, the consumable products 1300 have a minimum width W2. The width W1 is greater than the width W2 so that one of the consumable products 1300 can fit within the dispensing compartment 1050, but the width W1 is less than the width W2 times two so that two of the consumable products 1300 cannot fit within the dispensing compartment 1050. More specifically, the width W1 may be no greater than one and a half times the width W2, or more specifically no greater than the width W2 times 1.3.

This is because, as shown in FIG. 16B, while one of the consumable products 1301 is located entirely within the dispensing compartment 1050, a second one of the consumable products 1302 is partially located within the dispensing compartment 1050. In some embodiments, it is desirable to ensure that no more than one-half of the width of the second consumable product 1302 enters into the dispensing compartment 1050 so that when the cover member 1200 is moved from the closed state to the open state, the stopper wall 1210 and the divider wall 1115 force the second one of the consumable products 1302 to move back into the main compartment 1116 of the housing 1100. This ensures that only one of the consumable products 1300 (specifically, the one of the consumable products 1301) is dispensed each time the cover member 1200 is altered from the closed state to the open state.

Figure 16C:
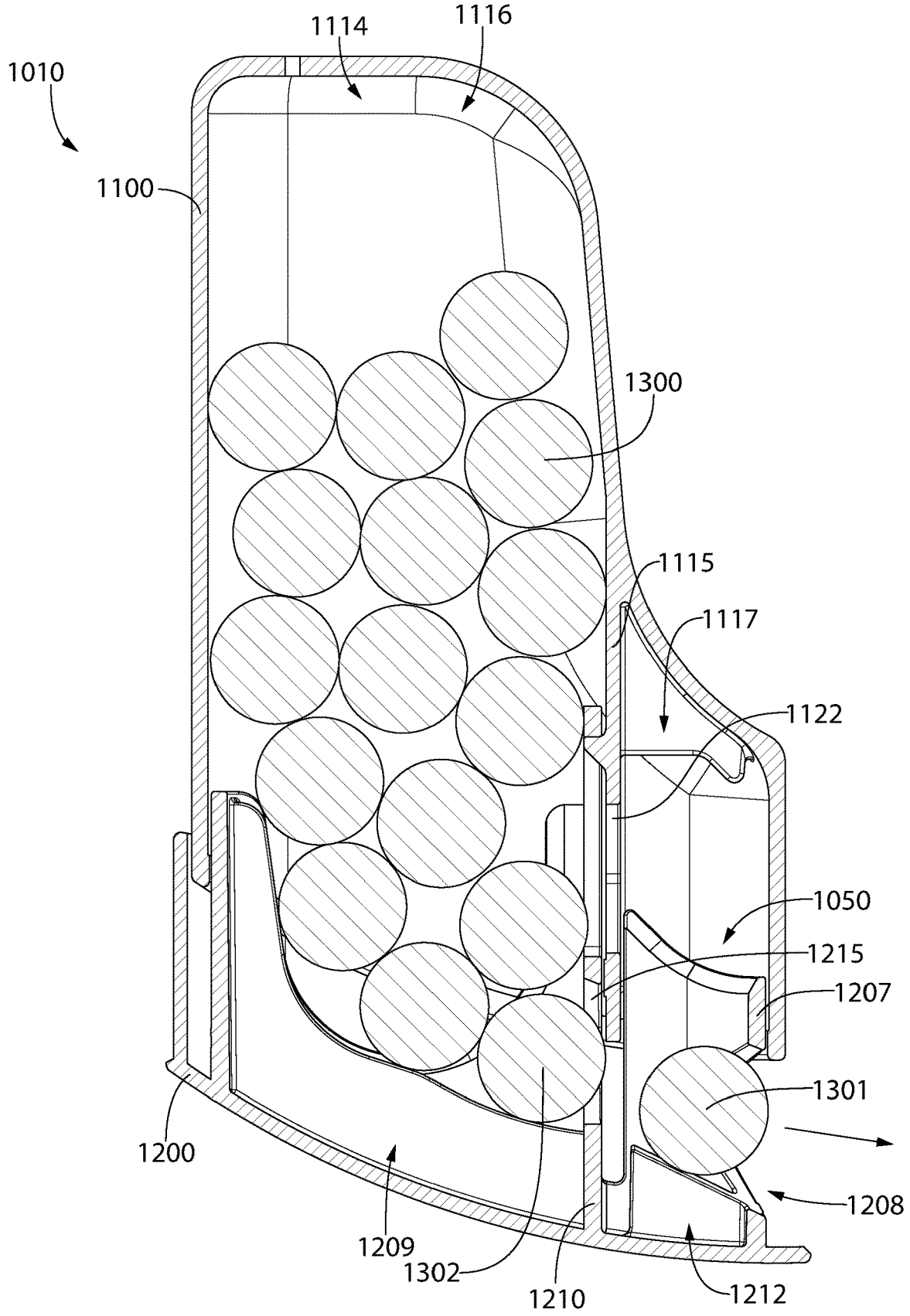
FIG. 16C is the cross-sectional view of FIG. 16B with the cover member having been altered from the closed state to the open state so that the consumable product within the dispensing compartment can be dispensed from the internal cavity into an external environment.

Referring now to FIGS. 16B and 16C, the dispensing of the one of the consumable products 1301 will be described. In FIG. 16B the cover member 1200 is in the closed state and in FIG. 16C the cover member 1200 is in the open state. To alter the cover member 1200 from the closed state to the open state, the cover member 1200 is translated in a first axial direction away from the housing 1100 (i.e., in the direction of the arrow labeled D1 in FIG. 16B). As the cover member 1200 is moved in the first axial direction D1, two important things happen. First, the dispensing aperture 1208 in the dispensing portion 1207 of the cover member 1200 becomes exposed, thereby enabling the one of the consumable products 1301 that is located within the dispensing compartment 1050 of the dispenser 1010 to be dispensed to the external environment.

Second, as the cover member 1200 moves relative to the housing 1100, the stopper wall 1210 of the cover member 1200 and the divider wall 1115 of the housing 1100 force the second one of the consumable capsules 1302 to move back into the main compartment 1116 of the housing 1100.

Furthermore, when the cover member 1200 is in the open state, a part of the divider wall 1115 of the housing 1100 extends over and at least partially blocks the pass-through opening 1215 of the stopper wall 1210 of the cover member 1200. Similarly, the stopper wall 1210 extends over and at least partially blocks the opening 1122 of the divider wall 1115. In FIG. 16C, the slot 1216 of the cover member 1200 is aligned with the opening 1122 of the divider wall 1115. However, the slot 1216 is much narrower than the opening 1122 of the divider wall 1115, so much of the stopper wall 1210 still blocks the opening 1122 of the divider wall 1115 in this position. The point is, when the cover member 1200 is in the open state as shown in FIG. 16C, the consumable products 1300 that are located within the main compartment 1116 are prevented from passing into the dispensing compartment 1117, and the one of the consumable products 1301 that is located within the dispensing compartment 1117 is prevented from passing into the main compartment 1116. As a result, the one of the dispensing products 1301, and only that one of the dispensing products 1301, is able to be dispensed from the dispenser 1010 to the exterior environment when the cover member 1200 is altered into the open state.

Thus, in the exemplified embodiment, the dispenser 1010 functions to dispense a single dose of the consumable product 1300 to the user each time the cover member 1200 is altered from the closed state to the open state. In the exemplified embodiment, the single dose comprises a single one of the consumable products 1300. However, in other embodiments the consumable products 1300 may be smaller in comparison to the dimensions of the dispensing compartment 1050 of the dispenser 1010 so that more than one of the consumable products 1300 may fit within the dispensing compartment 1050 at a time. However, the number or amount of the consumable products 1300 that may fit within the dispensing compartment 1050 at a time may be equal to one dose of the consumable product 1300, regardless of the specific or exact number. Moreover, some products which may be used as the consumable product 1300 do not have a specific dose requirement (e.g., mints or gum, for example). However, there is a desire to only dispense a certain number of pieces or a certain amount at a time. Thus, the dispenser 1010 described herein is also appropriate for use with consumable products that do not have specific dosage requirements.

It should be appreciated that it is necessary to ensure that one of the consumable products 1300 is located within the dispensing compartment 1050 of the dispenser 1010 before altering the cover member 1200 from the closed state to the open state. This is because once the cover member 1200 is in the open state, the consumable products 1300 in the main compartment 1116 are unable to pass into the dispensing compartment 1050 and are therefore unable to be dispensed. If the cover member 1200 is altered into the open state without any of the consumable products 1300 being located in the dispensing compartment 1050, the cover member 1200 will have to be altered back into the closed state, tilted, twisted, shook, or held so that one of the consumable products 1300 moves into the dispensing compartment 1050, and then re-altered into the open state to dispense.

Figure 16D:
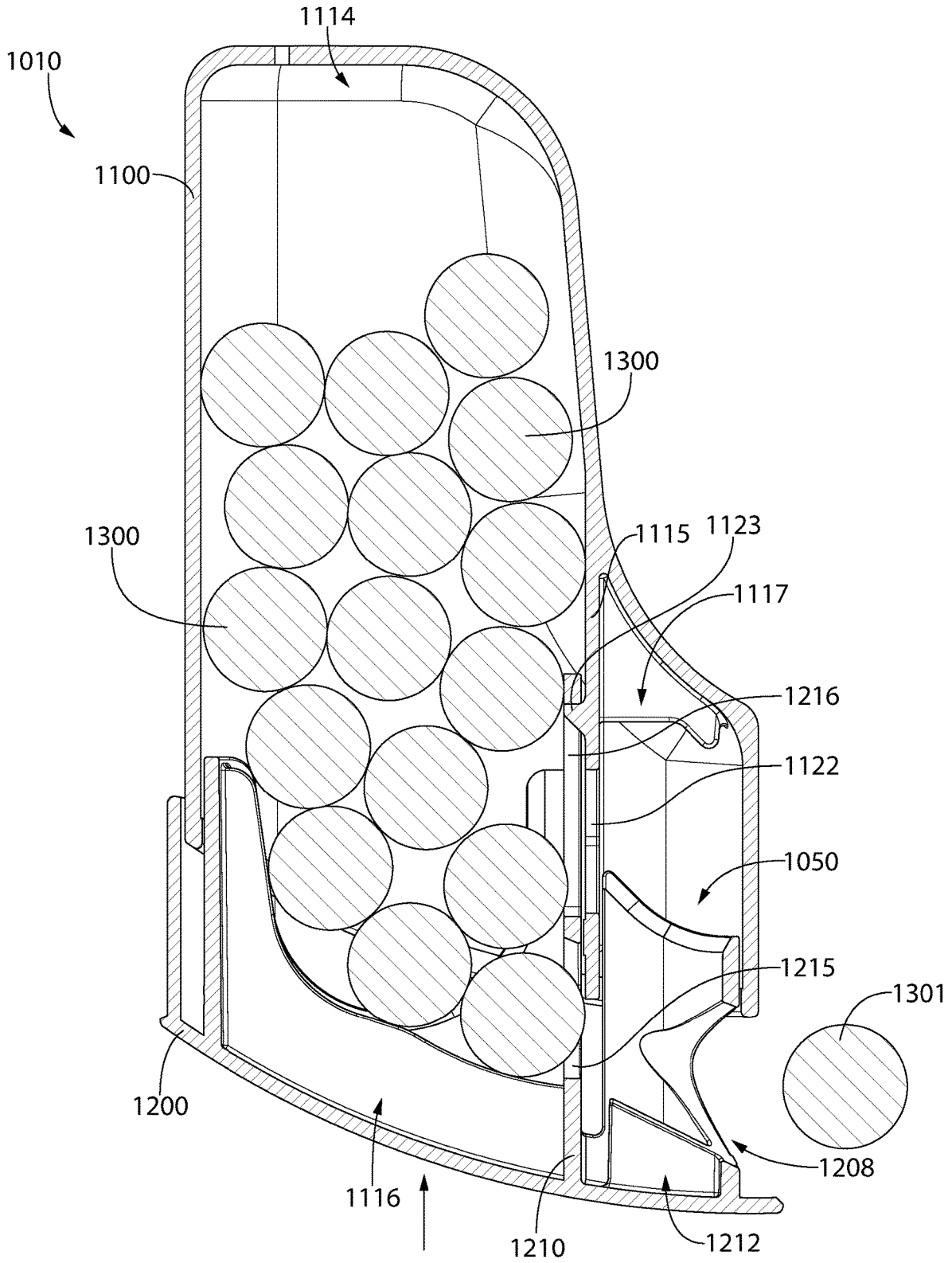
FIG. 16D is the cross-sectional view of FIG. 16C illustrating the consumable product exiting the dispensing compartment to the external environment.

Referring briefly to FIG. 16D, the dispenser 1010 is illustrated in the exact position as FIG. 16C with the cover member 1200 in the open state, but with the one of the consumable products 1301 being dispensed through the dispensing opening 1208. Specifically, once the cover member 1200 is altered into the open state, the one of the consumable products 1301 located in the dispensing compartment 1050 of the dispenser 1010 is able to be dispensed through the dispensing opening 1208, which is exposed and no longer blocked by any part of the sidewalls of the housing 1100. FIG. 16D also shows how additional ones of the consumable products 1300 are prevented from moving from the main compartment 1116 of the housing 1100 into the dispensing compartment 1050 of the dispenser 1010 due to the divider wall 1115 and the stopper wall 1210 blocking each other's openings 1120, 1215. The openings 1120, 1215 do not need to be entirely blocked, but rather sufficiently blocked to ensure that the consumable products 1300 cannot pass therethrough. Specifically, because the openings 1120, 1215 are not aligned, the consumable products 1300 could pass into the dispensing compartment 1050 by passing through either of the openings 1120, 1215. However, with the structure of the dispenser 1010, both of the openings 1120, 1215 are sufficiently blocked to prevent this from occurring when the cover member 1200 is in the open state.

With the dispenser 1010 in the position/state as shown in FIGS. 16C and 16D, the cover member 1200 is in the fully opened position. In the exemplified embodiment, the tab 1123 on the divider wall 1115 of the housing 1100 prevents further translation of the cover member 1200 in the direction D1 beyond that which his shown in FIGS. 16C and 16D due to its engagement with the surface of the stopper wall 1210 which surrounds the slot 1216. It should be readily apparent from viewing FIGS. 16C and 16D that the cover member 1200 cannot be moved axially further from the housing 1100 due to the engagement between the tab 1123 of the housing 1100 and the slot 1216 of the stopper wall 1210 of the cover member 1200.

Figure 16E:
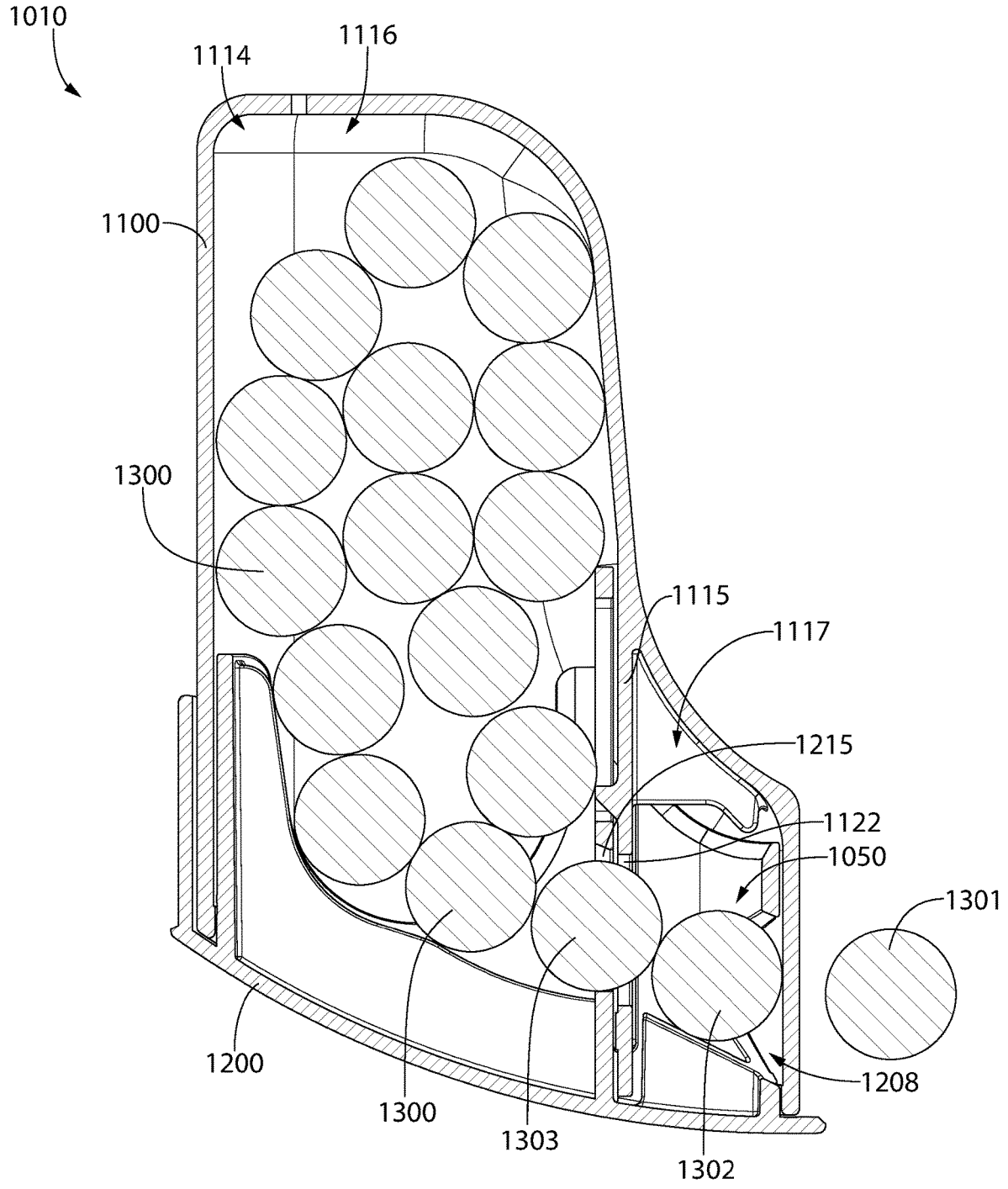
FIG. 16E is the cross-sectional view of FIG. 16D with the cover member having been altered from the open state to the closed state so that another one of the consumable products can move from the main compartment into the dispensing compartment.

Referring to FIGS. 16D and 16E, a description of what occurs when the cover member 1200 is altered back from the open state to the closed state will be described. To alter the cover member 1200 from the open state to the closed state, the cover member 1200 is moved in a second axial direction D2 (see arrow and label in FIG. 16D) which is opposite the first axial direction D1. Specifically, the cover member 1200 is translated back towards the housing 1100. Upon altering the cover member 1200 back into the closed state, the second one of the consumable products 1302 will pass through the openings 1215, 1122 in the stopper wall 1115 and the divider wall 1210, respectively, and enter into the dispensing compartment 1050 of the dispenser 1010. FIG. 16E illustrates a third one of the consumable products 1303 partially positioned within the openings 1215, 1122 and into the dispensing compartment 1050, but upon opening the cover member 1200 the third one of the consumable products 1303 will be forced back into the main compartment 1116 of the housing 1110 as was described above. Thus, the next time that the cover member 1200 is altered into the open state, the second one of the consumable products 1302 will be dispensed through the dispensing opening 208.

Moreover, when the cover member 1200 is in the closed state, the dispenser may be rotated back to its upright orientation (see FIG. 16A). If one of the consumable products is located within the dispensing compartment 1050, it will remain so positioned with the dispenser 1010 in the upright orientation so that it will be readily dispensed the next time the user opens the cover member 1200 even if this is done without first tilting or rotating the cover member 1200. Moreover, the dispenser 1010 may be rotated back to the upright orientation before altering the cover member 1200 from the open state to the closed state. In such a situation, it is likely that all of the consumable products 1300 will be located within the main compartment 1116 until the dispenser 1010 is once again rotated to the upside-down orientation.

In the exemplified embodiment, the movement of the cover member 1200 is entirely manual. In particular, a user must manually pull the cover member 1200 away from the housing 1100 to alter the cover member 1200 from the closed state to the open state, and the user must manually push the cover member 1200 back towards the housing 1100 to alter the cover member 1200 from the open state to the closed state. In alternative embodiments, biasing members such as springs or the like may be used to control the opening/closing of the cover member 1200 relative to the housing 1100.

For example, in one embodiment there may be an extension spring located between the cover member 1200 and the housing 1100. Extension springs are helically coiled wires that create a resistance to a pulling force. Thus, such extension springs will bias the cover member 1200 into the closed state by pulling the cover member 1200 towards the housing 1100. When a user applies a pulling force onto the cover member 1200 to alter the cover member 1200 into the open state, the extension springs will apply a spring force to attempt to pull the cover member 1200 back into the closed state. Thus, a user must maintain the pulling force on the cover member 1200 at a greater force than the spring force of the extension springs to maintain the cover member 1200 in the open state. As soon as the user releases the pulling force on the cover member 1200, the extension springs will pull the cover member 1200 back towards the housing 1100 into the closed state. Thus, a user will not be required to manually alter the cover member 1200 back into the closed state.

In yet another embodiment, there may be a compression spring located between the cover member 1200 and the housing 1100. Compression springs are helically coiled wires that create a resistance to a pushing force. Thus, such compression springs may bias the cover member into the open state by pushing the cover member 1200 away from the housing 1100. In such an embodiment, a user will need to push the cover member 1200 towards the housing 1100 with a force that exceeds the force of the compression springs to alter the cover member 200 into the closed state. Once in the closed state, the consumable product can be loaded into the dispensing compartment 1050 of the dispenser 1010. Then, the user can release the pushing force, at which time the compression springs will push the cover member 1200 away from the housing 100 and back into the open state, whereby the consumable product loaded into the dispensing compartment 1050 can be dispensed. These and other variations to the disclosed embodiment are possible and may fall within the scope of the invention claimed herein.

Moreover, the spring-type action could also be achieved with other types of springs or resilient elements. For example, the resilient elements may be plastic spring in some embodiments. Such plastic springs could be separate pieces or molded into the cap/cover member.

Finally, while in the exemplified embodiment the dispenser 1010 is a two-part construction, the invention is not to be so limited in all embodiments. Specifically, in the exemplified embodiment the two parts are the housing 1100 and the cover member 1200. In other embodiments, there may be an additional internal part which forms a wall that separates the main compartment 1116 from the dispensing compartment 1117. In such an embodiment, this additional internal part may snap together with the cover member 1200.

As used throughout, ranges are used as shorthand for describing each and every value that is within the range. Any value within the range can be selected as the terminus of the range. In addition, all references cited herein are hereby incorporated by reference in their entireties. In the event of a conflict in a definition in the present disclosure and that of a cited reference, the present disclosure controls.

While the invention has been described with respect to specific examples including presently preferred modes of carrying out the invention, those skilled in the art will appreciate that there are numerous variations and permutations of the above described systems and techniques. It is to be understood that other embodiments may be utilized and structural and functional modifications may be made without departing from the scope of the present invention. Thus, the spirit and scope of the invention should be construed broadly as set forth in the appended claims.

What is claimed is:

1. A dispenser comprising:

a first component comprising a storage cavity having an open end, the storage cavity containing a plurality of consumable products;

a closure member coupled to the first component and closing the open end of the storage cavity, the closure member comprising a body portion and a dispensing aperture extending through the body portion, the dispensing aperture being entirely enclosed by the body portion, the dispensing aperture configured to permit one of the consumable products to fit therethrough at a time; and a second component pivotably coupled to the first component, the second component comprising a cup-shaped member configured to hold the one of the consumable products and a blocker arm;

wherein the second component is pivotable relative to the first component between: a closed state in which the cup-shaped member of the second component is at least partially located within the dispensing aperture of the closure member for loading one of the consumable products onto the cup-shaped member; and an open state in which the cup-shaped member pivots away from the dispensing aperture to permit removal of the one of the consumable products from the cup-shaped member and the blocker arm prevents the consumable products remaining in the storage cavity from being dispensed through the dispensing aperture;

wherein the second component defines an internal cavity comprising a floor, the cup- shaped member extending upwardly from the floor, and wherein a lower portion of the first component and the closure member nest within the internal cavity of the second component when the second component is in the closed state.

2. The dispenser according to claim 1 wherein upon transitioning the second component from the closed state to the open state, the one of the consumable products remains loaded in the cup-shaped member until removed by a user.

3. The dispenser according to claim 2 wherein when the second component is in the open state the cup-shaped member and the one of the consumable products are exposed and accessible such that the user can directly touch the one of the consumable products for removal from the cup-shaped member.

4. The dispenser according to claim 3 wherein the second component further comprises a spring element integrally formed therewith, the spring element biasing the second component into the closed state, wherein the spring element protrudes from a floor of the second component along a spring axis that intersects the closure member at an oblique angle.

5. The dispenser according to claim 4 wherein the first component comprises a first pivot feature, and second component comprises a second pivot feature, and the closure member comprises a third pivot feature, the second pivot feature being sandwiched between the first and third pivot features, and each of the first, second, and third pivot features being arcuate.

6. The dispenser according to claim 5 wherein the first pivot feature comprises a pair of notches formed into a sidewall of the first component at a distal end of the sidewall, the second pivot feature comprises a first pair of arcuate protrusions extending from an inner surface of a sidewall of the second component, and the third pivot feature comprises a second pair of arcuate protrusions extending from an outer surface of the closure member.

7. The dispenser according to claim 6 wherein the second component comprises an inner surface comprising a slot and the first component comprises an outer surface comprising a ridge that nests within the slot of the second component, the ridge moving within the slot as the second component is altered between the first and second states.

8. The dispenser according to claim 7 wherein the closure member comprises a guide wall extending upwardly from the dispensing aperture for guiding the one of the consumable products into and through the dispensing aperture for capture by the cup-shaped member.

9. The dispenser according to claim 8 wherein the cup-shaped member comprise an upstanding annular wall that extends from a floor of the second component, an inner surface of the upstanding annular wall and the floor collectively defining a holding cavity for holding the one of the plurality of consumable products.

10. The dispenser according to claim 9 wherein the blocker arm extends from a distal end of the upstanding annular wall and extends over top of the one of the plurality of consumable products to retain the one of the plurality of consumable products within the holding cavity of the cup-shaped member as the second component is altered from the closed state to the open state.

11. The dispenser according to claim 10 further comprising:

wherein when the second component is in the closed state the blocker arm extends into the storage cavity of the first component; and wherein when the second component is in the open state the blocker arm is located external to the storage cavity of the first component with a distal end of the blocker arm positioned sufficiently close to or within the dispensing aperture to prevent the consumable products in the storage cavity of the first component from being dispensed through the dispensing aperture.

12. The dispenser according to claim 11 wherein altering the second component between the open and closed states comprises pivoting or rotating the second component a maximum pivoting angle of between 10° and 40° relative to the first component.

13. The dispenser according to claim 12 wherein the first component is transparent or translucent so that the consumable products within the storage cavity are at least partially visible.

14. The dispenser according to claim 13 wherein the cup-shaped member defines a holding cavity that extends along an axis, the cup-shaped member being defined by an annular wall, and wherein the blocker arm is an extension of the annular wall and protrudes from a distal end of the annular wall in an inward direction towards the axis.

15. The dispenser according to claim 14 wherein as the second component is altered from the closed state to the open state a rear portion of the second component wraps around a rear portion of the first component and a front portion of the second component pivots away from a front portion of the first component to create an opening through which a user can grab the one of the consumable products for removal from the cup-shaped member.

16. A dispenser comprising:

a storage component comprising a storage cavity containing a plurality of consumable products and a dispensing aperture that is configured to dispense one of the consumable products at a time, the storage component comprising a closure member closing an open end of the storage cavity, the closure member comprising a body portion and a dispensing aperture extending through the body portion, the dispensing aperture being entirely enclosed by the body portion;

a dispensing component pivotably coupled to the storage component, the dispensing component comprising a holding member configured to hold the one of the consumable products and a blocker arm;

wherein the dispensing component is pivotable relative to the storage component between:

a closed state in which the holding member of the dispensing component becomes loaded with one of the consumable products; and an open state in which the one of the consumable products becomes accessible to a user and the blocker arm prevents any of the consumable products remaining in the storage cavity from being dispensed through the dispensing aperture;

wherein the holding member comprises an upstanding wall that defines a holding cavity having an axis within which the one of the consumable products nests and wherein the blocker arm extends directly from the upstanding wall in a direction towards the axis.

* * * * *